US010598451B1

(12) United States Patent
Haidu

(10) Patent No.: US 10,598,451 B1
(45) Date of Patent: Mar. 24, 2020

(54) CHARGING ASSEMBLY FOR A FIREARM

(71) Applicant: Battlearms IP, LLC, Henderson, NV (US)

(72) Inventor: John M. Haidu, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 15/987,826

(22) Filed: May 23, 2018

Related U.S. Application Data

(60) Provisional application No. 62/603,365, filed on May 25, 2017.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
USPC ..... 89/1.4
See application file for complete search history.

(56) References Cited

U.S. PATENT DOCUMENTS 6,019,024 A * 2/2000 Robinson ..... F41A 3/72 89/1.42
7,231,861 B1 * 6/2007 Gauny ..... F41A 3/72 42/16
7,849,777 B1 * 12/2010 Zedrosser ..... F41A 3/26 42/16
D636,043 S * 4/2011 Olsen ..... F41A 3/72 D22/108
8,156,854 B2 * 4/2012 Brown ..... F41A 3/72 89/1.4
8,561,517 B2 * 10/2013 Brown ..... F41A 3/72 89/1.4
9,964,371 B1 * 5/2018 Huang ..... F41A 3/72
10,352,635 B2 * 7/2019 Noonan ..... F41C 23/16
2010/0000396 A1 * 1/2010 Brown ..... F41A 3/72 89/1.4
2011/0083551 A1 * 4/2011 Sirochman ..... F41A 3/72 89/191.01
2012/0318124 A1 * 12/2012 Brown ..... F41A 3/72 89/1.4
2013/0061737 A1 * 3/2013 Brown ..... F41A 3/72 89/1.4
2014/0060294 A1 * 3/2014 Brown ..... F41A 5/24 89/1.4

(Continued)

*Primary Examiner* — Joshua E Freeman
(74) *Attorney, Agent, or Firm* — Shaddock Law Group, PC

(57) ABSTRACT

A charging assembly having at least a charging bar with a protrusion having a bolt carrier engaging shoulder formed by the protrusion, a gas tube aperture formed through the charging bar protrusion, a first charging bar channel formed from a first end to the charging bar protrusion and a second charging bar channel formed from the charging bar protrusion to the second end, the gas tube aperture provides an aperture between the charging bar channels; a handle element removably attached or coupled to the charging bar; at least a portion of the charging bar is positionable within at least a portion of an upper receiver of the firearm and extends into a firearm handguard and the bolt carrier engagement shoulder is positioned to engage a shoulder of a bolt carrier; and wherein the handle element extends from the charging bar, through a handle element aperture formed through the handguard.

20 Claims, 19 Drawing Sheets

(56) References Cited

U.S. PATENT DOCUMENTS

| | | | | |
|---|---|---|---|---|
| 2014/0068988 | A1* | 3/2014 | Donahue | F41A 3/72 42/69.01 |
| 2014/0224103 | A1* | 8/2014 | Brown | F41A 3/72 89/1.4 |
| 2014/0345444 | A1* | 11/2014 | Hillman | G01N 15/06 89/1.4 |
| 2016/0047614 | A1* | 2/2016 | Larson, Jr. | F41G 11/003 89/191.01 |
| 2016/0178298 | A1* | 6/2016 | Daniel | F41A 3/72 89/1.4 |
| 2018/0142975 | A1* | 5/2018 | Hoon | F41A 9/52 |
| 2018/0195820 | A1* | 7/2018 | Noonan | F41A 3/72 |
| 2019/0056189 | A1* | 2/2019 | Lowe | F41A 3/72 |
| 2019/0257601 | A1* | 8/2019 | Brown | F41A 3/84 |
| 2019/0316859 | A1* | 10/2019 | Kling | F41A 3/72 |

* cited by examiner

CHARGING ASSEMBLY FOR A FIREARM

CROSS-REFERENCE TO RELATED APPLICATIONS

This patent application claims the benefit of U.S. Patent Application Ser. No. 62/603,365, filed May 25, 2017, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a charging assembly adaptable to be used with a firearm.

2. Description of Related Art

A number of firearms operate based on a gas blowback system. One such firearm is the M-16, M-4, and AR-15 family of firearms. The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style firearm, when a round is fired, gas from the burning propellant forces the bullet through the barrel 70. Before the bullet leaves the barrel 70, a portion of the gas enters a gas port in the upper part of the barrel 70 under the gas block 80 (or front sight). The gas port directs gas through a portion of the gas block 80 (or front sight) and into the gas tube 90, which directs the gas into a cylindrical gas aperture 42 of the bolt carrier key 40, and drives the bolt carrier group 10 (including the bolt carrier 20, the firing pin, the firing pin retaining pin 60, the cam pin 30, and the bolt 50) rearward.

The buffer, which exerts a spring biasing force on the rear of the bolt carrier group 10, is forced rearward by the bolt carrier group 10, compressing the recoil spring. During this rearward movement, a cam pin track or slot 22 in the upper portion of the bolt carrier group 10 acts on the bolt cam pin 30, translating the rearward linear movement of the carrier into rotational movement, thereby rotating the cam pin 30 and bolt 50 clockwise so that the bolt locking lugs are unlocked from the barrel extension locking lugs. As the rearward movement of the bolt carrier group 10 continues, the empty cartridge case is extracted from the chamber, and ejected through the ejection port.

As the bolt carrier group 10 clears the top of an inserted magazine and the empty cartridge case is expelled, a new round is pushed into the path of the bolt 50 by the upward thrust of the magazine follower and spring.

As the bolt carrier group 10 continues to move rearward, it overrides the hammer and forces the hammer down into the receiver, compressing the hammer spring, and allowing the rear hook of the hammer to engage with the hammer disconnect.

When the bolt carrier group 10 reaches its rearmost position (when the rear of the buffer contacts the rear of the buffer tube), the compressed recoil spring expands, driving the buffer assembly forward with enough force to drive the bolt carrier group 10 forward, toward the chamber, initiating chambering of the waiting round from the magazine into the chamber.

The forward movement of the bolt 50 ceases when the locking lugs of the bolt 50 pass between the barrel extension locking lugs and the round is fully chambered. When the bolt carrier group 10 enters the final portion of its forward movement, the bolt cam pin 30 emerges from the cam pin guide channel in the upper receiver and moves along the cam pin slot 22, rotating the bolt 50 counterclockwise. This rotation locks the bolt 50 to the barrel extension (by interaction of the bolt locking lugs and the barrel extension locking lugs). The locking of the bolt 50 completes the cycle of operation and, when the trigger is released, the rear hammer hook hammer slips from the disconnect and the front hammer hook is caught by the sear of the trigger. The firearm is then ready to be fired again.

Certain firearms, such as the M-16, AR-10, AR-15 and M-4 style firearms, incorporate use of a charging handle, which allows a user to manually draw the bolt carrier group 10 to the rear, permitting various functions to include ejecting a spent shell, loading a round from a magazine, loading a shell by hand or clearing of the firearm after a misfire.

The typical charging handle comprises an elongate shaft that extends from a substantially T-shaped rear handle to a forward end adapted to engage the bolt carrier 10. The charging handle is inserted through an opening in the upper receiver and has a shoulder located proximate the forward end that will engage a shoulder 27, positioned above a shelf 25 of the bolt carrier 10.

A spring-loaded, pivoting latch includes a hook or claw that engages a recess in the upper receiver of the firearm, to maintain the charging handle in a closed position relative to the upper receiver of the firearm. The pivoting latch is typically located on the left side of the charging handle and when the spring bias of the pivoting latch is overcome, by a user pulling reward on the left side of the charging handle, engaging the pivoting latch, the latch pivots to an unlocked position and allows the user to pull the charging handle rearward to manipulate the bolt.

The charging handle is positioned proximate the top of the upper receiver and extends rearward from the upper receiver. The charging handle is drawn rearward, beyond the rear of the upper receiver, by use of the T-shaped rear handle, towards the stock or rear of the firearm.

In most instances, charging the firearm requires the user to lower the firearm away from his/her face in order to pull the charging handle to the rear. Particularly in situations where rapid or accurate fire is desired, moving the firearm away from the user's face to charge the firearm is a significant disadvantage.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The disadvantages and shortcomings of the prior art are overcome by the features and elements of the charging assembly of the present disclosure. The advantages of the present disclosure are attained by providing, in an exemplary, nonlimiting embodiment, a charging assembly that comprises a charging bar and a handle element.

The charging bar is positioned so as to extend from the interior of an upper receiver, into an interior of a handguard. The handle element extends through a portion of the handguard and allows the bolt carrier to be charged by slidably manipulating the handle element between a locked or disengaged position and an unlocked or engaged position. Thus, a user can manipulate the handle element, along a portion of the handguard, and charge the firearm while maintaining a desired cheek weld on the firearm.

In various exemplary, nonlimiting embodiments, the charging assembly for a firearm comprises at least some of a charging bar extending from a first end to a second end, wherein a charging bar protrusion extends from the charging bar, proximate the second end, wherein a bolt carrier engaging shoulder is formed by the charging bar protrusion, wherein a gas tube aperture is formed through the charging bar protrusion, along a longitudinal axis of the charging bar, wherein a first charging bar channel is formed in the charging bar from the first end to the charging bar protrusion and wherein a second charging bar channel is formed in the charging bar from the charging bar protrusion to the second end, and wherein the gas tube aperture is formed so as to provide an aperture through the charging bar protrusion, between the first charging bar channel and the second charging bar channel, and wherein an engagement finger extends from the first end of the charging bar, wherein at least one handle element aperture is formed through at least one of two side walls of the charging bar, and wherein at least one charging bar fastener aperture is formed through at least one of the side walls of the charging bar; a handle element, wherein the handle element comprises a handle base portion, a handle element extension portion extending from the handle base portion, and a handle projection extending from the handle base portion, opposite the handle element extension portion; wherein the handle projection is formed so as to be removably positioned within at least a portion of the at least one handle element aperture of the charging bar, and wherein the handle element is removably attached or coupled to the charging bar proximate the first end of the charging bar; wherein at least a portion of the charging bar is positionable so as to be slidably received within at least a portion of an upper receiver of the firearm and extend into at least a portion of a firearm handguard and wherein at least a portion of the first charging bar channel and the second charging bar channel are formed so as to receive at least a portion of a firearm gas tube therein, through the gas tube aperture, such that the charging bar is positionable between the firearm handguard and at least a portion of the firearm gas tube of the firearm, and such that the bolt carrier engagement shoulder of the charging bar is positioned within the upper receiver of the firearm so as to engage a shoulder of a bolt carrier of the firearm; and wherein the handle element extends from the charging bar, through an elongate handle element aperture formed through at least a portion of the handguard.

In various exemplary, nonlimiting embodiments, the first charging bar channel and the second charging bar channel are formed so as to receive at least a portion of a firearm gas tube therein and wherein the gas tube aperture formed in the charging bar protrusion is formed so as to allow at least a portion of the firearm gas tube to be repeatably slidable therethrough.

In various exemplary, nonlimiting embodiments, the gas tube aperture formed in the charging bar protrusion is formed so as to repeatably, slidably receive at least a portion of a bolt carrier key of the bolt carrier at least partially therein.

In various exemplary, nonlimiting embodiments, the first charging bar channel is a substantially "U" shaped channel and wherein the second charging bar channel is a substantially "U" shaped channel.

In various exemplary, nonlimiting embodiments, the first charging bar channel and the second charging bar channel are defined between a top wall and the side walls of the charging bar.

In various exemplary, nonlimiting embodiments, alignment projections extend from the side walls of the charging bar, proximate the second end, wherein the alignment projections extend from the side walls so as to interact with raceways formed in the upper receiver of the firearm.

In various exemplary, nonlimiting embodiments, at least one charging element aperture is formed through each of the side walls of the charging bar.

In various exemplary, nonlimiting embodiments, at least one charging bar fastener aperture is formed through each of the side walls of the charging bar.

In various exemplary, nonlimiting embodiments, the engagement finger is a spring biased engagement finger formed to releasably engage an engagement element of the handguard.

In various exemplary, nonlimiting embodiments, the handle base portion comprises a handle element fastener aperture formed through at least a portion of the handle base portion, wherein when the handle projection is removably positioned within at least a portion of the at least one handle element aperture, the handle element fastener aperture is aligned with the charging bar fastener aperture of the charging bar, so as to allow a fastener to pass at least partially through the handle element fastener aperture and into the charging bar fastener aperture.

In various exemplary, nonlimiting embodiments, the handguard further comprises an engagement element positioned within the handguard so as to interact with the engagement finger, when the charging bar is in a locked or disengaged position to releasably maintain the charging bar in the locked or disengaged position.

In various exemplary, nonlimiting embodiments, the charging assembly for a firearm comprises at least some of a charging bar, wherein a charging bar protrusion extends from the charging bar, proximate a second end of the charging bar, wherein a bolt carrier engaging shoulder is formed by the charging bar protrusion, wherein a gas tube aperture is formed through the charging bar protrusion, along a longitudinal axis of the charging bar, wherein a first charging bar channel is formed in the charging bar from a first end of the charging bar to the charging bar protrusion and wherein a second charging bar channel is formed in the charging bar from the charging bar protrusion to the second end, and wherein the gas tube aperture is formed so as to provide an aperture through the charging bar protrusion, between the first charging bar channel and the second charging bar channel, and wherein an engagement finger extends from the first end of the charging bar, and wherein at least one charging bar fastener aperture is formed through at least one of the side walls of the charging bar; a handle element, wherein the handle element comprises a handle base portion and a handle element extension portion extending from the handle base portion; wherein the handle element is removably attached or coupled to the charging bar proximate the first end of the charging bar; wherein at least a portion of the charging bar is positionable so as to be slidably received within at least a portion of an upper receiver of the firearm and extend into at least a portion of a firearm handguard and wherein at least a portion of the first charging bar channel and the second charging bar channel are formed so as to receive at least a portion of a firearm gas tube therein, through the gas tube aperture, such that the charging bar is positionable between the firearm handguard and at least a portion of the firearm gas tube of the firearm, and such that the bolt carrier engagement shoulder of the charging bar is positioned within the upper receiver of the firearm so as to engage a shoulder of a bolt carrier of the firearm; and wherein the handle element extends from the charging bar, through an elongate handle element aperture formed through at least a portion of the handguard.

In various exemplary, nonlimiting embodiments, the charging assembly for a firearm comprises at least some of a charging bar with a charging bar protrusion extending from the charging bar, a bolt carrier engaging shoulder is formed by the charging bar protrusion, a gas tube aperture is formed through the charging bar protrusion, along a longitudinal axis of the charging bar, a first charging bar channel is formed in the charging bar from a first end to the charging bar protrusion and a second charging bar channel is formed in the charging bar from the charging bar protrusion to the second end, and wherein the gas tube aperture is formed so as to provide an aperture through the charging bar protrusion, between the first charging bar channel and the second charging bar channel; a handle element is removably attached or coupled to the charging bar; wherein at least a portion of the charging bar is positionable so as to be slidably received within at least a portion of an upper receiver of the firearm and extend into at least a portion of a firearm handguard and wherein at least a portion of the first charging bar channel and the second charging bar channel are formed so as to receive at least a portion of a firearm gas tube therein, through the gas tube aperture, such that the charging bar is positionable between the firearm handguard and at least a portion of the firearm gas tube of the firearm, and such that the bolt carrier engagement shoulder of the charging bar is positioned within the upper receiver of the firearm so as to engage a shoulder of a bolt carrier of the firearm; and wherein the handle element extends from the charging bar, through an elongate handle element aperture formed through at least a portion of the handguard.

In various exemplary, nonlimiting embodiments, an engagement finger extends from the first end of the charging bar and wherein the handguard further comprises an engagement element positioned within the handguard so as to interact with the engagement finger, when the charging bar is in a locked or disengaged position to releasably maintain the charging bar in the locked or disengaged position.

Accordingly, the present disclosure separately and optionally provides an improved charging handle for firearms.

The present disclosure separately and optionally provides an improved, ambidextrous charging handle for firearms.

The present disclosure separately and optionally provides an improved charging handle for firearms, which is capable of allowing a user to keep a target sighted while charging the weapon.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of what may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE INVENTION

For simplicity and clarification, the design factors and operating principles of the charging assembly according to an exemplary embodiment of the present disclosure are explained with reference to various exemplary embodiments of a charging assembly according to an exemplary embodiment of the present disclosure. The basic explanation of the design factors and operating principles of the charging assembly is applicable for the understanding, design, and operation of the charging assembly of the present disclosure. It should be appreciated that the charging assembly can be adapted to many applications where a charging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "charging assembly", "handle element", and "handguard" are used for basic explanation and understanding of the operation of the systems, methods, and apparatuses of the present disclosure. Therefore, the terms "charging assembly", "handle element", and "handguard" are not to be construed as limiting the systems, methods, and apparatuses of the present disclosure.

Figure 33:
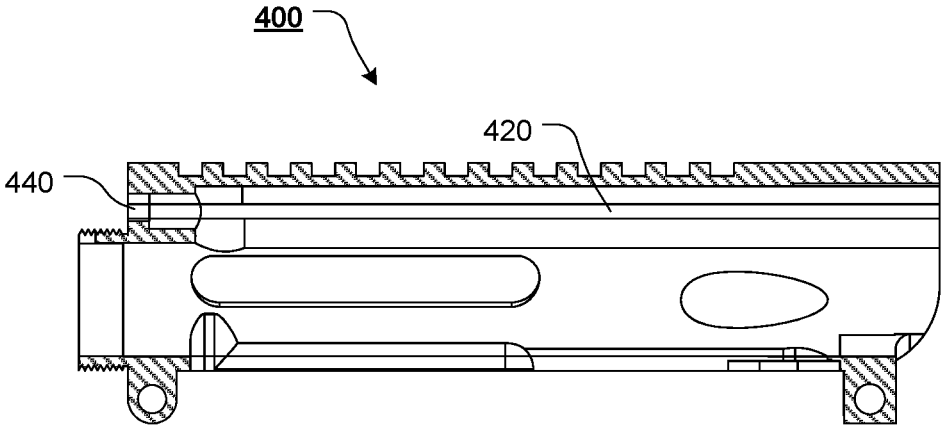
FIG. 33 illustrates a left, cross-sectional view of an exemplary embodiment of a firearm upper receiver to be utilized in conjunction with a charging assembly, according to an exemplary embodiment of the present disclosure.
Figure 34:
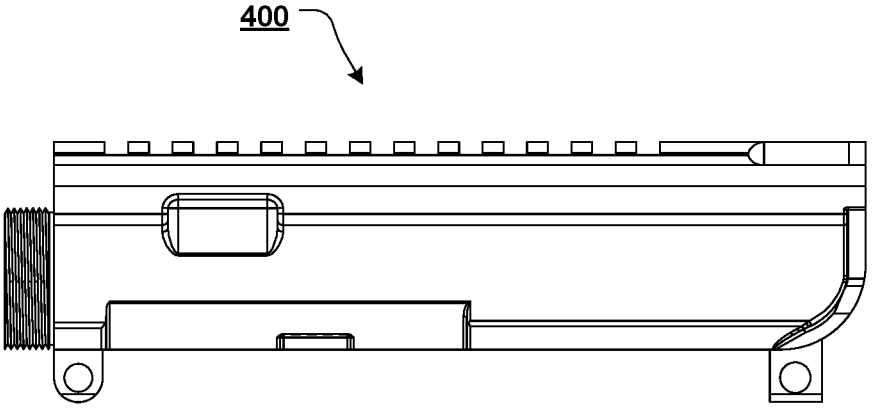
FIG. 34 illustrates a left side view of an exemplary embodiment of a firearm upper receiver to be utilized in conjunction with a charging assembly, according to an exemplary embodiment of the present disclosure.
Figure 35:
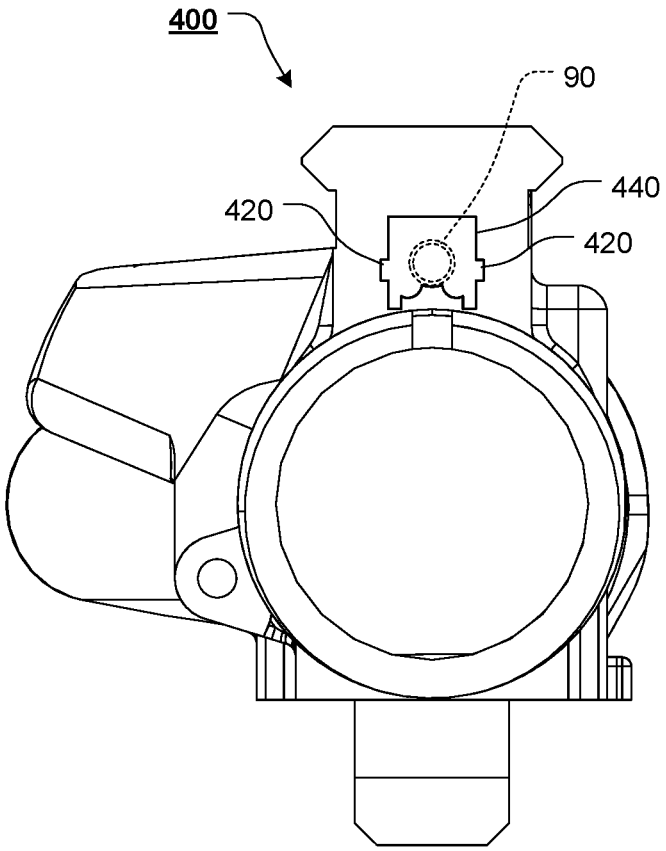
FIG. 35 illustrates a front view of an exemplary embodiment of a firearm upper receiver to be utilized in conjunction with a charging assembly, according to an exemplary embodiment of the present disclosure.
Figure 36:
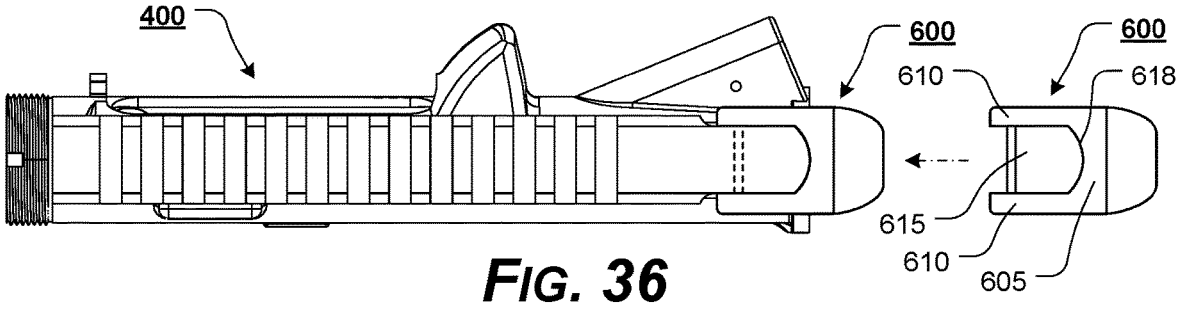
FIG. 36 illustrates a top view of an exemplary embodiment of a firearm upper receiver and an exemplary cover element, according to an exemplary embodiment of the present disclosure.
Figure 37:
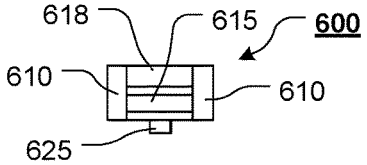
FIG. 37 illustrates a front view of an exemplary embodiment of an exemplary cover element, according to an exemplary embodiment of the present disclosure.
Figure 38:
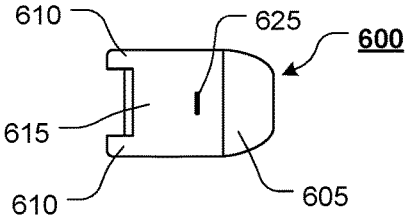
FIG. 38 illustrates a bottom view of an exemplary embodiment of an exemplary cover element, according to an exemplary embodiment of the present disclosure.
Figure 39:
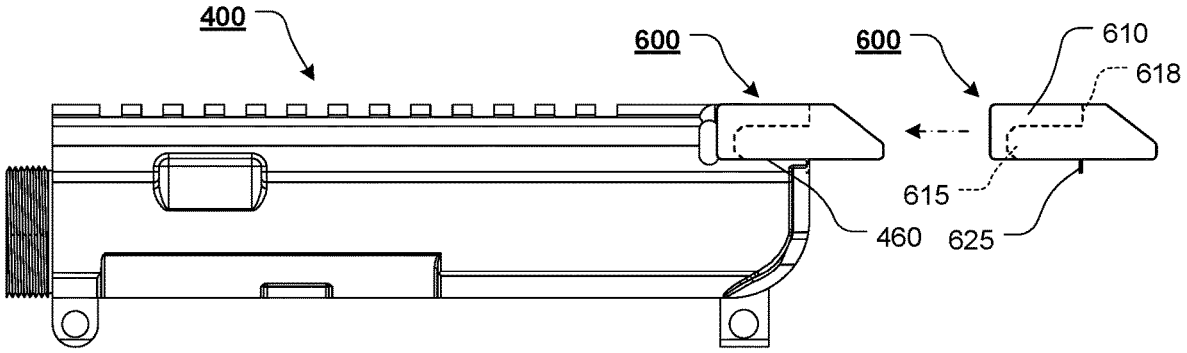
FIG. 39 illustrates a left side view of an exemplary embodiment of a firearm upper receiver and an exemplary cover element, according to an exemplary embodiment of the present disclosure.
Figure 40:
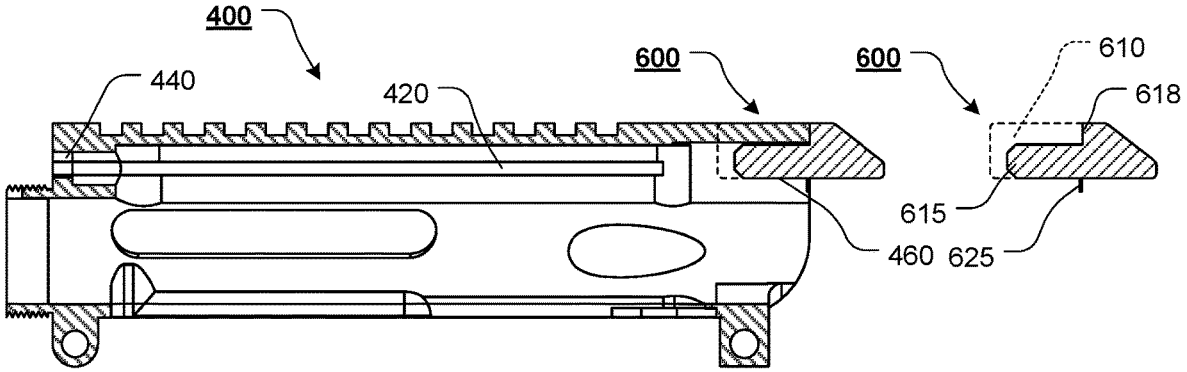
FIG. 40 illustrates a left side, cutaway view of an exemplary embodiment of a firearm upper receiver and an exemplary cover element, according to an exemplary embodiment of the present disclosure.
Figure 41:
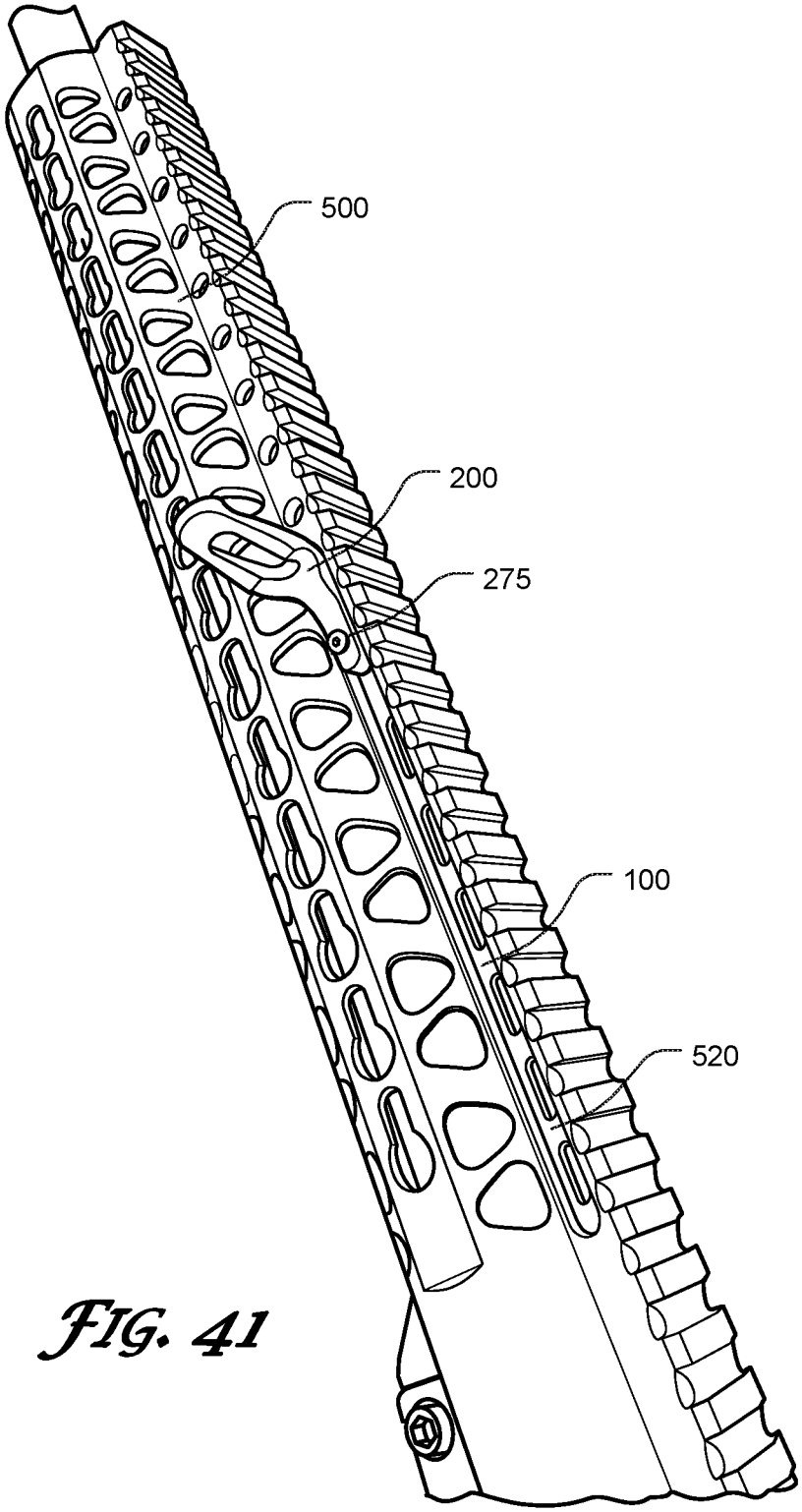
FIG. 41 illustrates a left side, upper, perspective view of an exemplary embodiment of a complete firearm upper receiver incorporating an exemplary embodiment of a charging assembly, according to an exemplary embodiment of the present disclosure.
Figure 42:
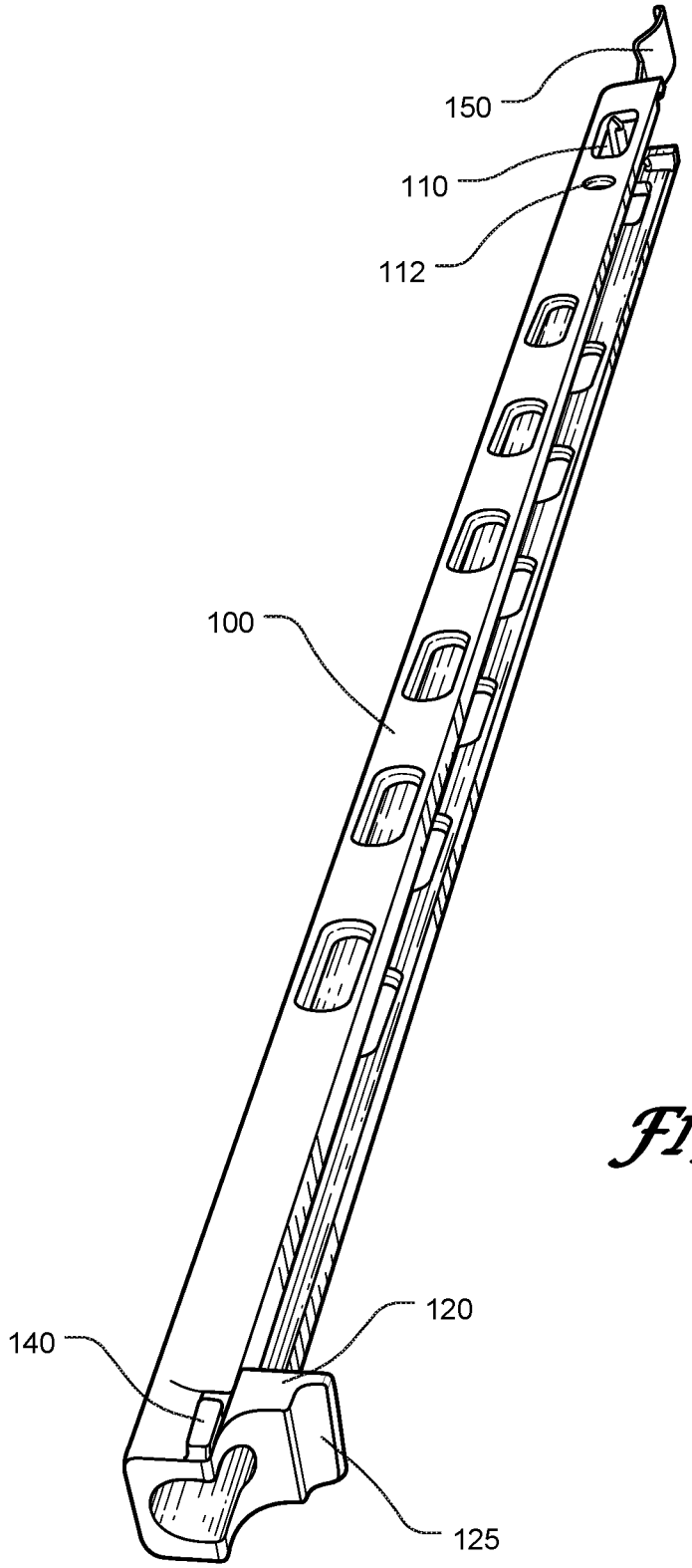
FIG. 42 illustrates a right side, lower, perspective view of a charging assembly, according to an exemplary embodiment of the present disclosure.
Figure 43:
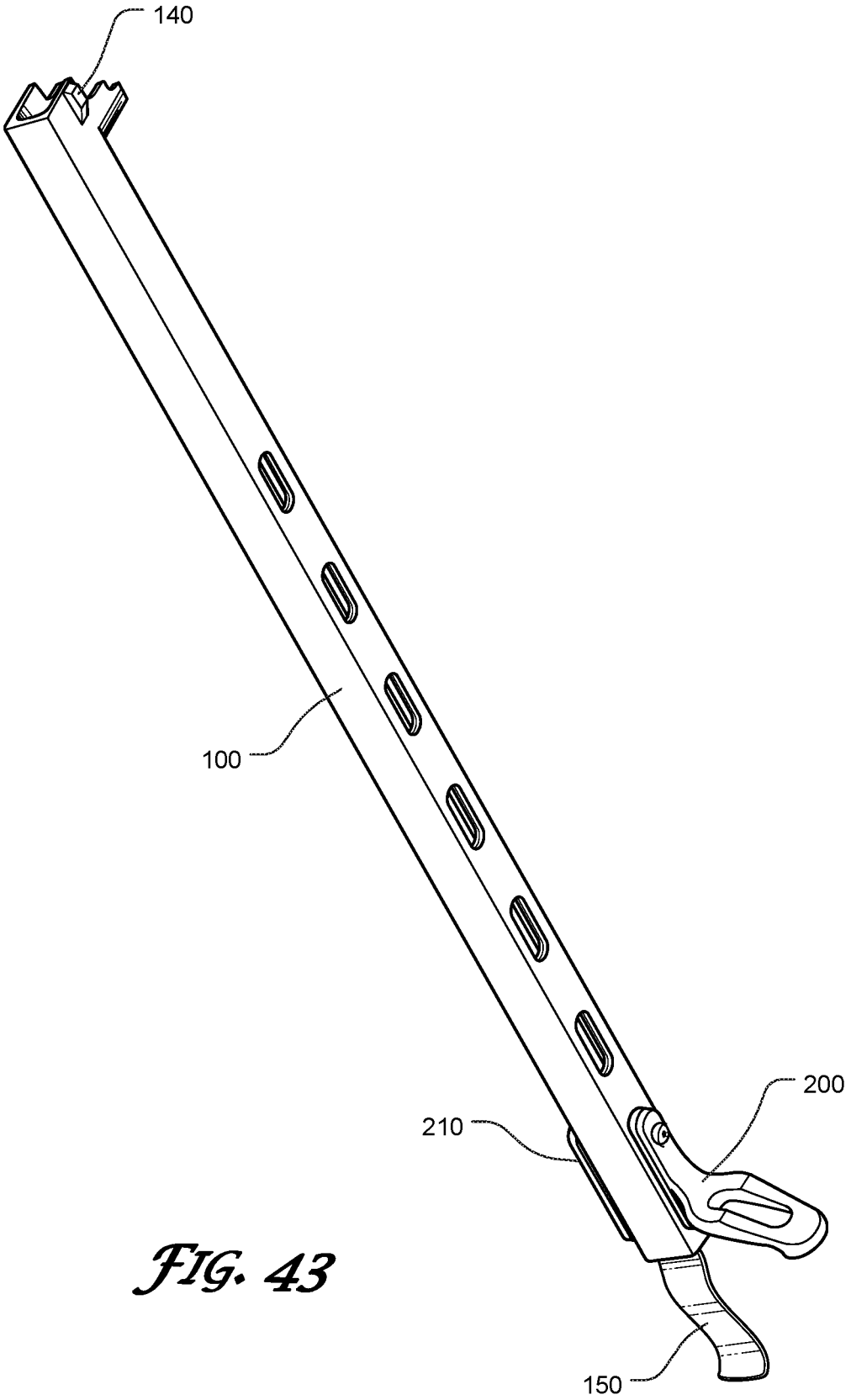
FIG. 43 illustrates an upper, rear, perspective view of a charging assembly, according to an exemplary embodiment of the present disclosure.
Figure 44:
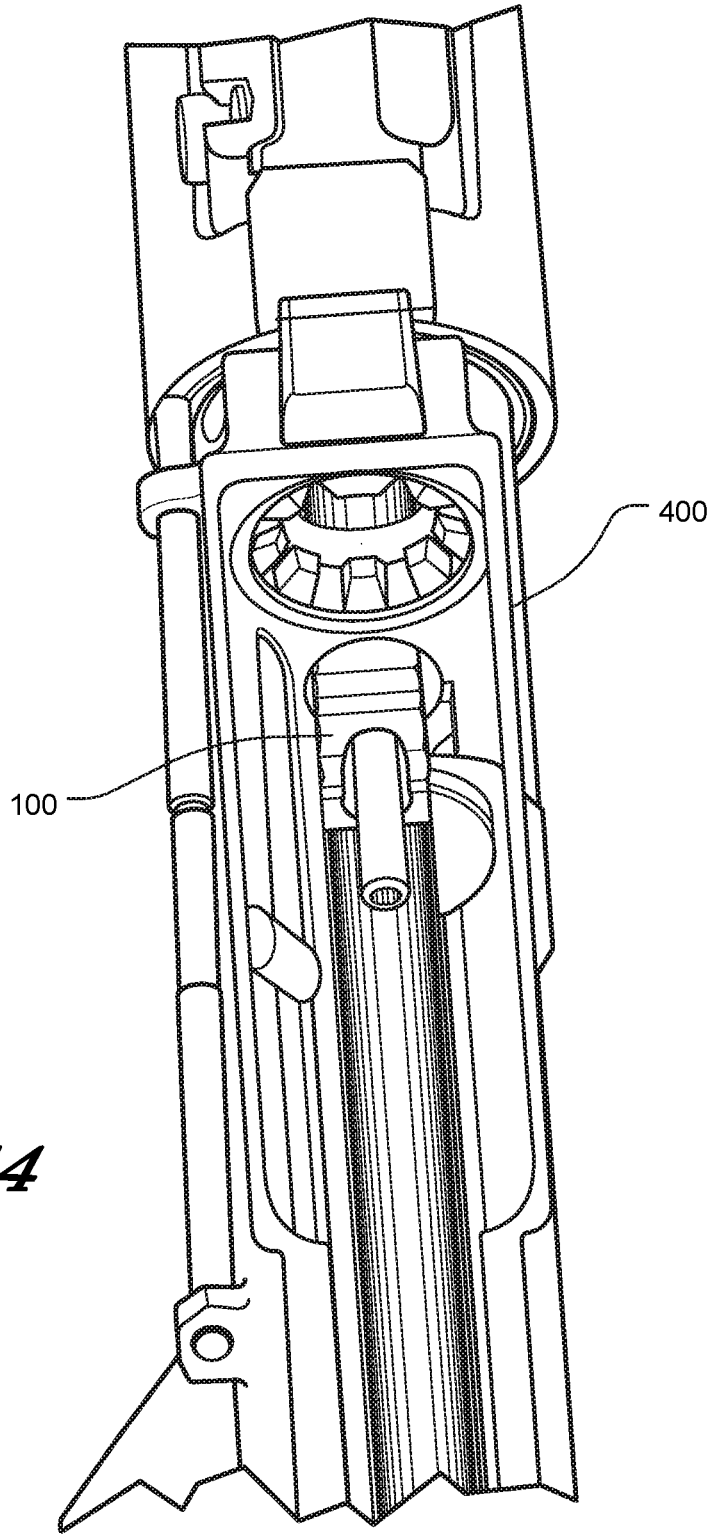
FIG. 44 illustrates a lower, perspective view of a charging assembly within a firearm upper receiver, according to an exemplary embodiment of the present disclosure.

Turning now to the drawing FIGS., FIGS. 2-11 illustrate various elements and/or aspects of an exemplary embodiment of the charging bar 100, according to this disclosure. FIGS. 12-17 illustrate various elements and/or aspects of an exemplary embodiment of the handle element 200, FIGS. 18-25 illustrate various elements and/or aspects of an exemplary embodiment of the charging assembly, FIGS. 26-32 illustrate various elements and/or aspects of an exemplary embodiment of the charging assembly being utilized in conjunction with a firearm upper receiver, FIGS. 33-35 illustrate various elements and/or aspects of an exemplary embodiment of an exemplary upper receiver to be utilized in conjunction with the charging assembly of the present disclosure, FIGS. 36-40 illustrate various exemplary, non-limiting embodiments of a cover element to be utilized in conjunction with a known upper receiver for a firearm, and FIGS. 41-44 illustrate various elements and/or aspects of an exemplary embodiment of the charging assembly and an exemplary charging assembly being utilized in conjunction with a firearm upper receiver, according to this disclosure.

As illustrated in FIGS. 2-20 and 26-32, the exemplary embodiment of the charging bar 100 of the present disclosure comprises a charging bar 100 having a body 105 that extends from a first end 101 to a second end 101. A charging bar protrusion 120 extends downward from the charging bar 100, proximate the second end 101. The charging bar protrusion 120 has a bolt carrier engagement shoulder 125 formed facing the second end 102 of the charging bar 100. A bottom portion of the charging bar protrusion 120 is formed such that when the charging bar 100 is appropriately positioned within the upper receiver 400 and the handguard 500, the bolt carrier engaging shoulder 125 is formed to interact with the shoulder 27 of the bolt carrier 20. The charging bar protrusion 120 extends so as to allow the charging bar protrusion 120 to slide atop the shelf 25 of the bolt carrier 20.

A gas tube aperture 135 is formed through the charging bar protrusion 120, along a longitudinal axis, $A_L$, of the charging bar 100. The gas tube aperture 135 is sized and shaped so as to allow at least a portion of the gas tube 90 and the bolt carrier key 40 of the bolt carrier 20 to be repeatably, slidably received at least partially through the gas tube aperture 135. In various exemplary embodiments, the gas tube aperture 135 is sized and shaped so as to allow at least a portion of the gas tube 90 and at least a portion of the bolt carrier key 40 to be repeatably, slidably received completely through the gas tube aperture 135.

A first charging bar channel 131 is formed in the charging bar 100, which extends from the first end 101 to the charging bar protrusion 120. A second charging bar channel 132 is formed in the charging bar 100, which extends from the second end 101 to the charging bar protrusion 120. The gas tube aperture 135 provides an aperture through the charging bar protrusion 120, between the first charging bar channel 131 and the second charging bar channel 132, which joins the first charging bar channel 131 to the second charging bar channel 132.

In various exemplary, nonlimiting embodiments, the first charging bar channel 131 and the second charging bar channel 132 are each defined between a top wall 107 of the charging bar 100 and two opposing side walls 108 and 109 of the charging bar 100. The opposing side walls 108 and 109 extend downward from the top wall 107.

In certain exemplary, nonlimiting embodiments, the first charging bar channel 131 and the second charging bar channel 132 are substantially "U" shaped channels, joined together by a substantially circular gas tube aperture 135.

Thus, as illustrated most clearly in FIGS. 29-32, when the charging bar 100 is appropriately positioned within the upper receiver 400, the first end 101 extends through an appropriately shaped charging bar receiving aperture 440 formed in the upper receiver 400 and into an interior cavity formed in at least a portion of the firearm handguard 500. The charging bar 100 is slidable through the charging bar receiving aperture 440 until the charging bar protrusion 120 contacts a front wall surface of the interior of the upper receiver 400. The side walls 108 and 109 of the charging bar 100 straddle at least portions of the gas tube 90, such that the gas tube 90 is positioned within at least a portion of the first charging bar channel 131, through the gas tube aperture 135, and within at least a portion of the second charging bar channel 132. Thus, the charging bar 100 is positioned within an interior portion of the handguard 500 and above and around at least a portion of the gas tube 90.

When the bolt carrier group 10 is appropriately positioned within the interior of the upper receiver 400, the bolt carrier engagement shoulder 125 of the charging bar 100 is positioned within the upper receiver 400 so as to engage the shoulder 27 of the bolt carrier 20.

The gas tube aperture 135 is formed so as to allow the gas tube 90 and the gas key 40 to repeatably be slidable within the second charging bar channel 132 and the gas tube aperture 135, while the first charging bar channel 131 is formed so as allow the gas tube 90 to be repeatably slidable within the first charging bar channel 131.

While the first charging bar channel 131, second charging bar channel 132, and gas tube aperture 135 have been described as being sized and shaped so as to be utilized in conjunction with a gas tube 90, it should be appreciated that the first charging bar channel 131, the second charging bar channel 132, and the gas tube aperture 135 may optionally be sized and shaped so as to operate in conjunction with a piston and bolt carrier group of a gas piston-driven firearm.

An engagement finger 150 extends from the first end 101 of the charging bar 100. In various exemplary, nonlimiting embodiments, the engagement finger 150 is formed of an elongate, contoured portion of material that is resilient or spring biased to releasably engage an engagement element 550 positioned or formed within the handguard 500. In various exemplary embodiments, the engagement finger 150 comprises a curved portion of spring steel. In various exemplary embodiments, the engagement element 550 comprises a pin or other protrusion that extends within at least a portion of the handguard 500.

Alternatively, the engagement finger 150 and/or the engagement element 550 may optionally be replaced by a spring-loaded detent and corresponding detent receiving notch optionally formed in either the handguard 500 or the charging bar 100. Thus, a spring-loaded detent may be positioned within and extend from the charging bar 100 so as to interact with a detent receiving notch formed in the handguard 500. Alternatively, a spring-loaded detent may be positioned within and extend from the handguard 500 so as to interact with a detent receiving notch formed in the charging bar 100.

Figure 30:
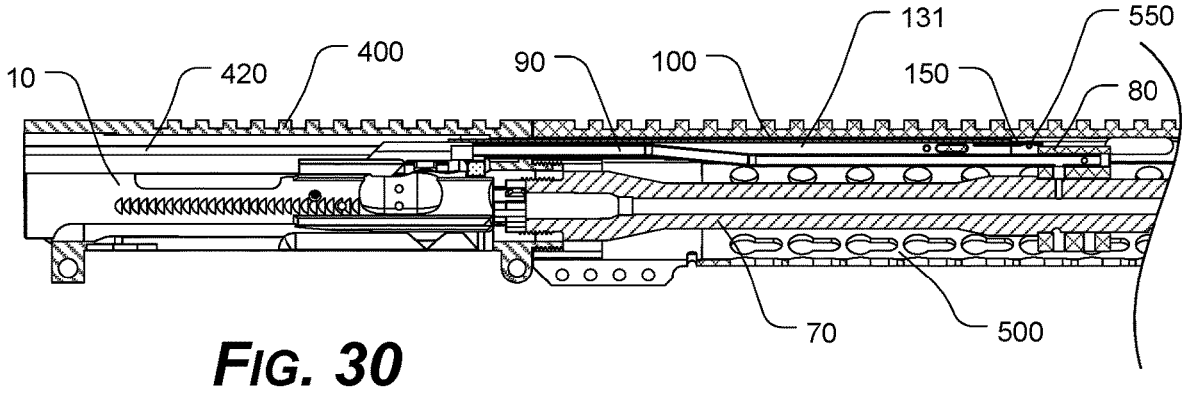
FIG. 30 illustrates a partial, right side, cross-sectional view of an exemplary embodiment of a complete firearm upper receiver incorporating an exemplary embodiment of a charging assembly, wherein the charging assembly is in the locked or disengaged position, according to an exemplary embodiment of the present disclosure.
Figure 31:
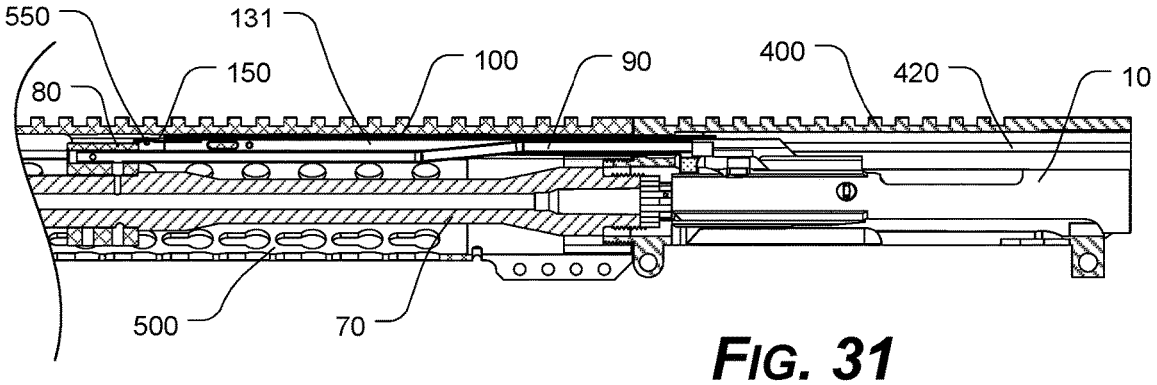
FIG. 31 illustrates a partial, left side, cross-sectional view of an exemplary embodiment of a complete firearm upper receiver incorporating an exemplary embodiment of a charging assembly, wherein the charging assembly is in the locked or disengaged position, according to an exemplary embodiment of the present disclosure.
Figure 32:
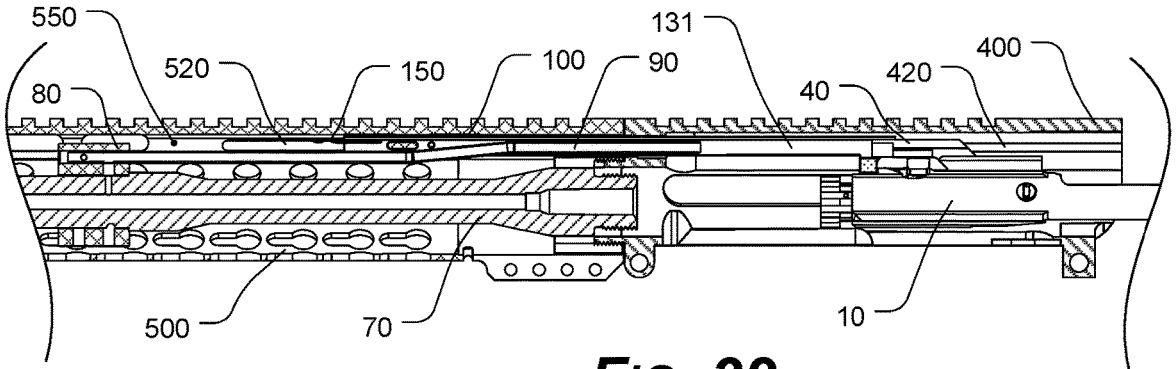
FIG. 32 illustrates a partial, left side, cross-sectional view of an exemplary embodiment of a complete firearm upper receiver incorporating an exemplary embodiment of a charging assembly, wherein the charging assembly is in the unlocked or engaged position, according to an exemplary embodiment of the present disclosure.

Thus, when the charging bar 100 is in a locked position relative to the upper receiver 400 and the handguard 500, as illustrated, for example, in FIGS. 30-31, the engagement finger 150 is releasably engaged with the engagement element 550 to maintain the charging bar 100 and the locked position relative to the upper receiver 400 and the handguard 500. In the locked position, the bolt carrier engagement shoulder 125 may optionally make contact with the shoulder 27 of the bolt carrier 20, but does not apply rearward force to the shoulder 27 or the bolt carrier 20.

In various exemplary, nonlimiting embodiments, alignment projections 140 extend from the side walls 108 and 109 of the charging bar 100, proximate the second end 101. If included, the alignment projections 140 extend from the side walls 108 and 109 so as to interact with raceways 420 formed in the upper receiver 400. By allowing the alignment projections 140 to interact with the raceways 420, as the charging bar 100 is slidably moved between the locked or disengaged position, as illustrated, for example, in FIGS. 30-31, and the unlocked or disengaged position, as illustrated, for example, in FIG. 32, interaction between the alignment projections 140 and the raceways 420 help to maintain proper alignment between the charging bar 100 and the upper receiver 400.

In various exemplary embodiments, at least one handle element aperture 110 may optionally be formed through at least one, and optionally both, of the two side walls 108 and 109 of the charging bar 100. The at least one handle element aperture 110 is formed proximate the first end of the charging bar 100. The at least one handle element aperture 110, if included, is formed so as to allow a portion or all of a handle projection 210 to be removably positioned within at least a portion of the at least one handle element aperture 110.

One or more charging bar fastener apertures 112 may optionally be formed through at least one, and optionally both, of the two side walls 108 and 109 of the charging bar 100. The one or more charging bar fastener apertures 112, if included, are formed proximate the at least one handle element aperture 110. In various exemplary embodiments, the one or more charging bar fastener apertures 112 are internally threaded so as to allow a fastener element 275 to be threaded late attached or coupled to the charging bar 100. In various exemplary embodiments, the fastener element 275 is an externally threaded screw.

In various exemplary embodiments, the charging bar 100 is substantially rigid and is formed of aluminum. Alternate materials of construction of the charging bar 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the charging bar 100 is a design choice based on the desired appearance and functionality of the charging bar 100.

It should also be understood that the overall size and shape of the charging bar 100 and the various portions thereof is a design choice based upon the desired functionality and/or appearance of the charging bar 100.

Figure 45:
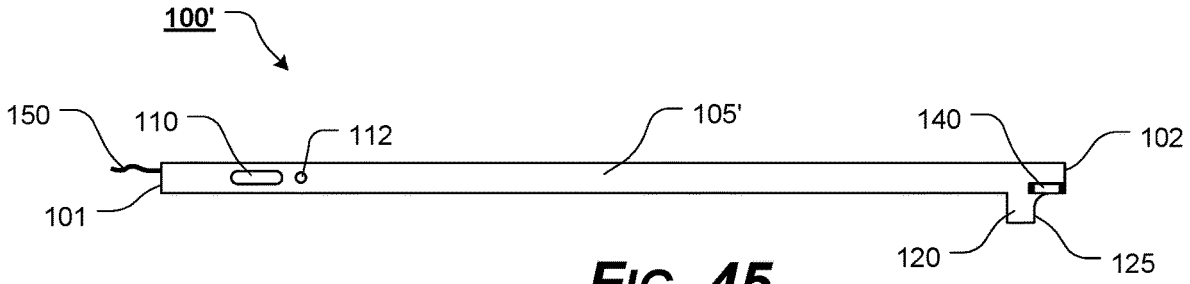
FIG. 45 illustrates a left side view of an exemplary embodiment of a charging bar, according to an exemplary embodiment of the present disclosure.
Figure 46:
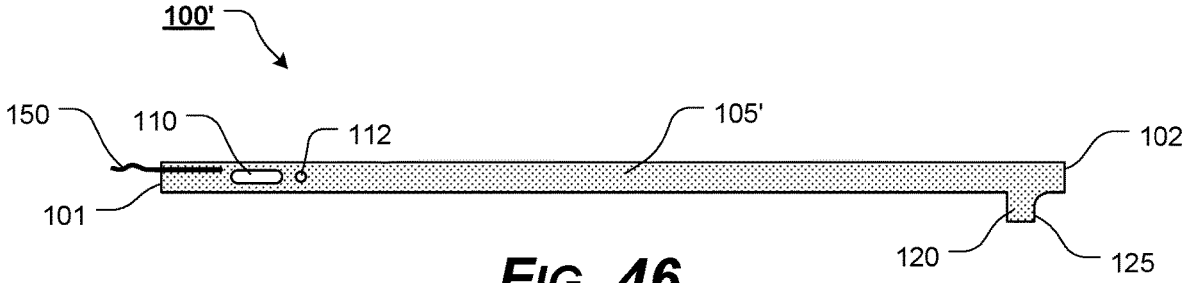
FIG. 46 illustrates a left side, cross-sectional view of an exemplary embodiment of a charging bar, according to an exemplary embodiment of the present disclosure.

While the charging bar 100 has been illustrated and described as including a first charging bar channel 131, a second charging bar channel 132, and a gas tube aperture 135, in certain exemplary, nonlimiting embodiments, as illustrated in FIGS. 45 and 46, the charging bar 100' of the present disclosure may comprise a substantially solid body 105' that does not include a first charging bar channel 131, a second charging bar channel 132, or a gas tube aperture 135. In these exemplary embodiments, the charging bar 100' extends from a from a first end 101 to a second end 101 and, similar to the charging bar 100, comprises a charging bar protrusion 120 having a bolt carrier engagement shoulder 125, at least one optional handle element aperture 110, one or more charging bar fastener apertures 112, charging bar alignment projections 140.

The charging bar 100' may optionally be utilized in conjunction with an upper receiver for a firearm that does not include a gas tube, such as, for example, a blowback style firearm (i.e., a 9 mm or other pistol caliber firearm). In these exemplary embodiments, it is not necessary to include a first charging bar channel 131, a second charging bar channel 132, or a gas tube aperture 135, and an engagement finger 150.

Thus, it should be appreciated that the charging bar 100 and/or 100' of the present disclosure can be configured to be utilized in conjunction with a firearm having a gas tube, a piston system, and/or a blowback system.

The handle element 200 comprises a handle element base portion 220, a handle element extension portion 230 extending from the handle element base portion 220, and optionally a handle projection 210 extending from the handle element base portion 220, opposite the handle element extension portion 230.

The overall size and shape of the handle element extension portion 230 is a design choice, but is typically formed so as to provide a sufficient area to allow a user's finger to grasp at least a portion of the handle element extension portion 230 to manipulate the handle element 200 (and, in turn, the charging bar 100) from at least the locked position to an unlocked position. Portions of the handle element may be shaped or textured so as to provide increased purchase for user's finger.

If included, the handle element projection 210 is formed so as to be removably positioned within at least a portion of the at least one handle element aperture 110 of the charging bar 100. Thus, it should be appreciated that the handle element projection 210 may be of a sufficient length to be positioned within at least a portion of the at least one handle element aperture 110 of the side wall 108 or the side wall 109. Alternatively, the handle element projection 210 may be a sufficient length to be positioned within at least a portion of the at least one handle element aperture 110 of the side wall 108 and extend into or through the at least one handle element aperture 110 of the side wall 109. Thus, by interaction between the handle element projection 210 and the at least one handle element aperture 110, the handle element 200 may be at least partially removably attached or coupled to the charging bar 100 proximate the first end 101 of the charging bar 100.

In various exemplary, nonlimiting embodiments, the handle element base portion 220 comprises a handle element fastener aperture 222 formed through at least a portion of the handle element base portion 220. The handle element fastener aperture 222 is formed such that when the handle projection 210 is removably positioned within at least a portion of the at least one handle element aperture 110, the handle element fastener aperture 222 is aligned with the charging bar fastener aperture 112 of the charging bar 100 so as to allow the fastener 275 to pass at least partially through the handle element fastener aperture 222 and into the charging bar fastener aperture 112, thus allowing the handle element 200 to be further attached or coupled to the charging bar 100, as illustrated, for example, in FIGS. 18-20.

If included, the handle element projection 210 may include a notch 212 formed in at least a portion of the handle element projection 210, proximate a center of the handle element projection 210. In this manner, the notch 212 may be positioned proximate the gas tube 90 to provide additional clearance between the gas tube 90 and the handle element projection 210.

Figure 1:
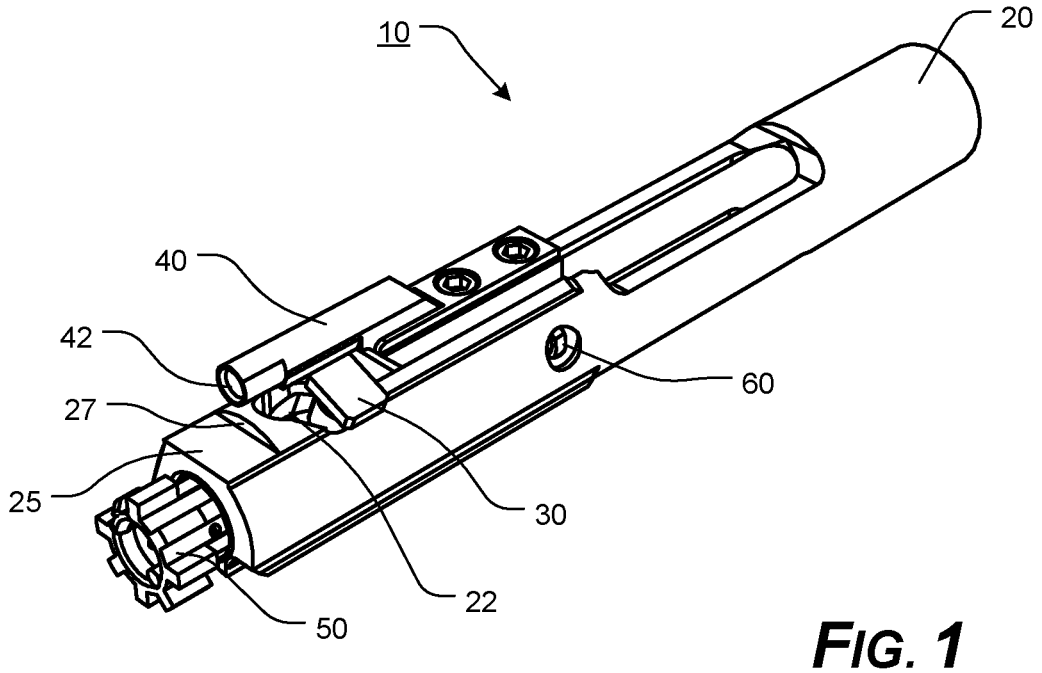
FIG. 1 PRIOR ART
FIG. 1 illustrates a front perspective view of an exemplary bolt carrier group.
Figure 2:
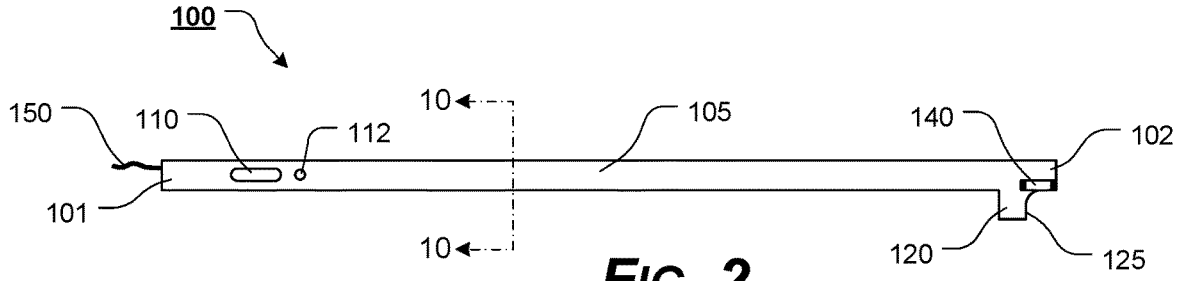
FIG. 2 illustrates a left side view of an exemplary embodiment of a charging bar, according to an exemplary embodiment of the present disclosure.
Figure 3:
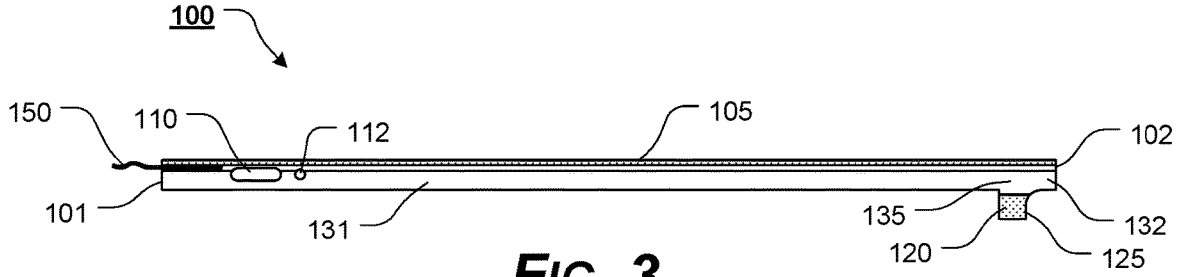
FIG. 3 illustrates a left side, cross-sectional view, taken along line 3-3 of FIG. 8, of an exemplary embodiment of a charging bar, according to an exemplary embodiment of the present disclosure.
Figure 4:
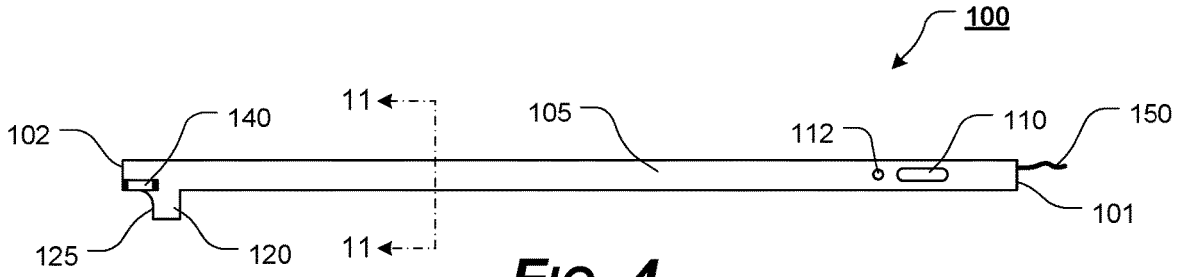
FIG. 4 illustrates a right side view of an exemplary embodiment of a charging bar, according to an exemplary embodiment of the present disclosure.
Figure 5:
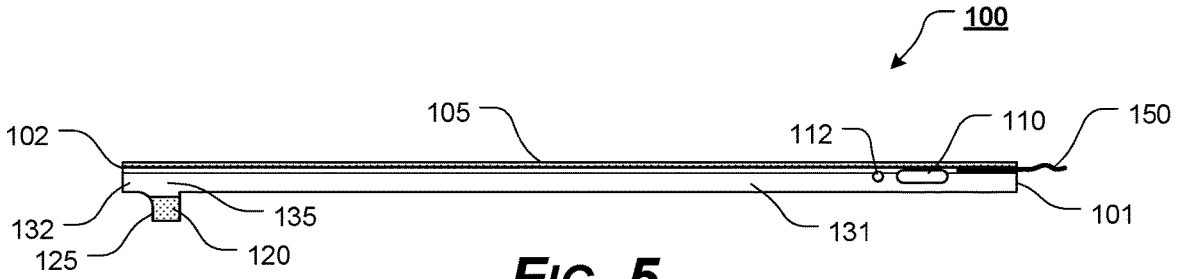
FIG. 5 illustrates a right side, cross-sectional view, taken along line 5-5 of FIG. 9, of an exemplary embodiment of a charging bar, according to an exemplary embodiment of the present disclosure.
Figure 6:
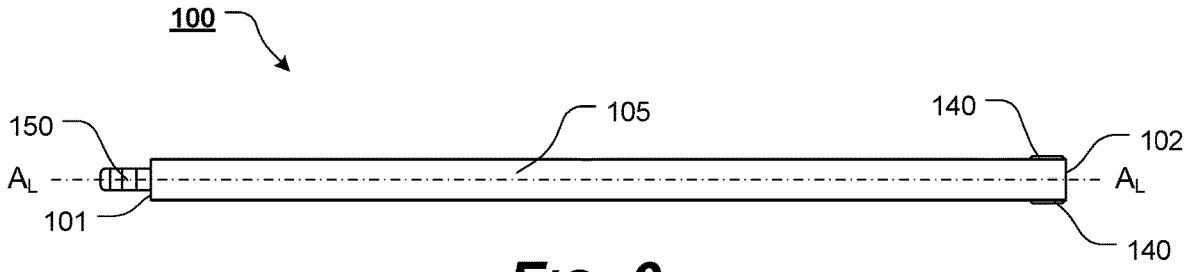
FIG. 6 illustrates a top view of an exemplary embodiment of a charging bar, according to an exemplary embodiment of the present disclosure.
Figure 7:
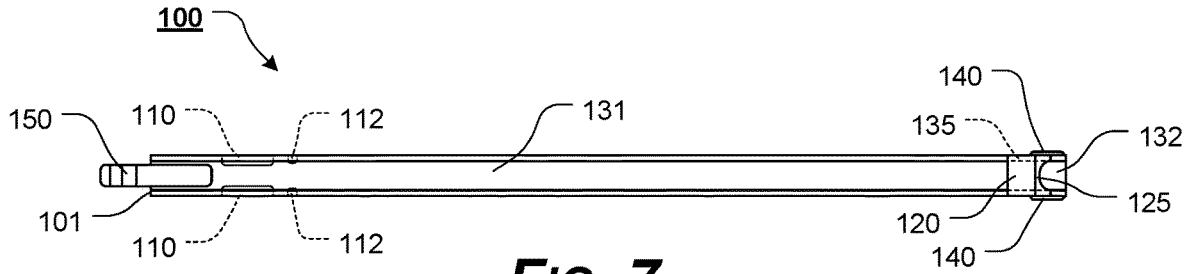
FIG. 7 illustrates a bottom view of an exemplary embodiment of a charging bar, according to an exemplary embodiment of the present disclosure.
Figure 8:
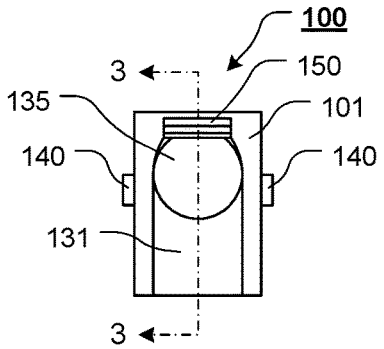
FIG. 8 illustrates a front view of an exemplary embodiment of a charging bar, according to an exemplary embodiment of the present disclosure.
Figure 9:
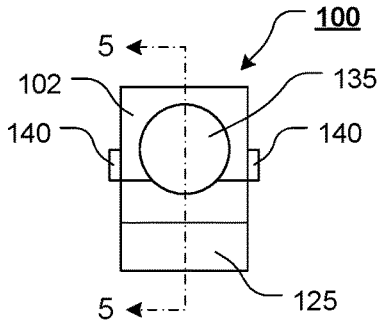
FIG. 9 illustrates a rear view of an exemplary embodiment of a charging bar, according to an exemplary embodiment of the present disclosure.
Figure 10:
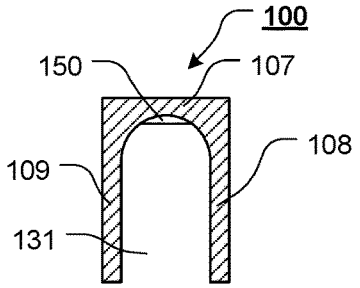
FIG. 10 illustrates a forward-looking, cross-sectional view, taken along line 10-10 of FIG. 2, of an exemplary embodiment of a charging bar, according to an exemplary embodiment of the present disclosure.
Figure 11:
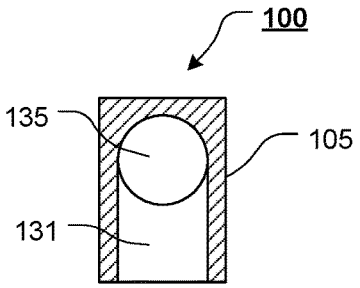
FIG. 11 illustrates a rearward looking, cross-sectional view, taken along line 11-11 of FIG. 4, of an exemplary embodiment of a charging bar, according to an exemplary embodiment of the present disclosure.
Figure 12:
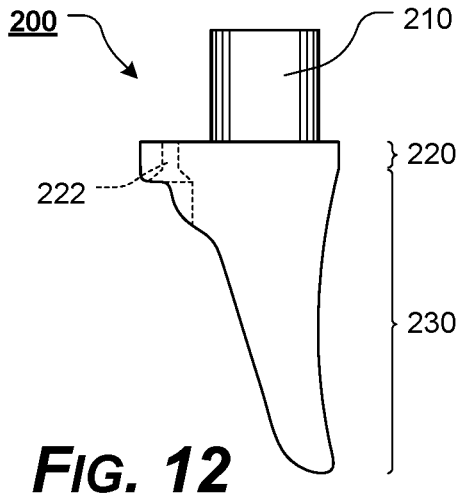
FIG. 12 illustrates a bottom view of an exemplary embodiment of a handle element, according to an exemplary embodiment of the present disclosure.
Figure 13:
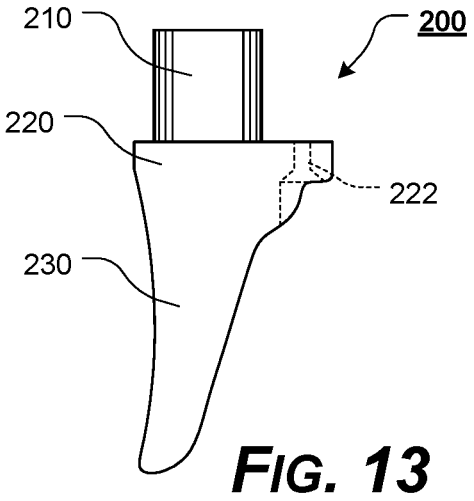
FIG. 13 illustrates a top view of an exemplary embodiment of a handle element, according to an exemplary embodiment of the present disclosure.
Figure 14:
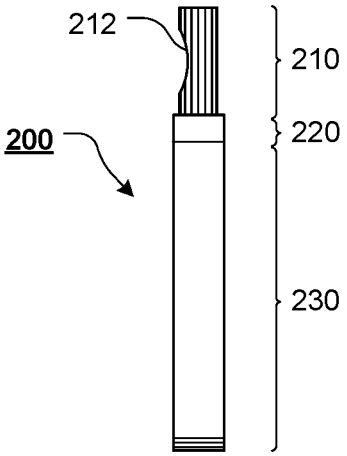
FIG. 14 illustrates a front view of an exemplary embodiment of a handle element, according to an exemplary embodiment of the present disclosure.
Figure 15:
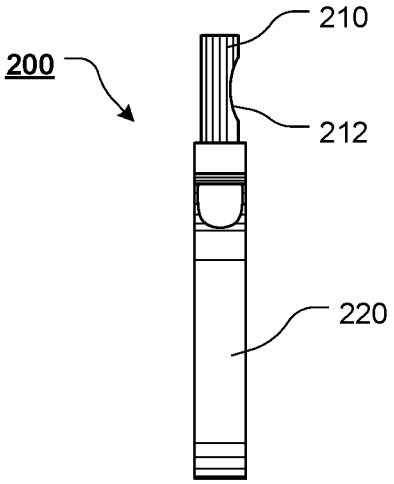
FIG. 15 illustrates a rear view of an exemplary embodiment of a handle element, according to an exemplary embodiment of the present disclosure.
Figure 16:
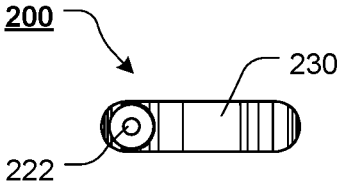
FIG. 16 illustrates a left side view of an exemplary embodiment of a handle element, according to an exemplary embodiment of the present disclosure.
Figure 17:
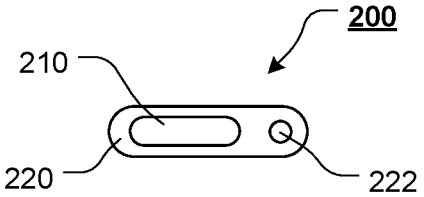
FIG. 17 illustrates a right side view of an exemplary embodiment of a handle element, according to an exemplary embodiment of the present disclosure.
Figure 18:
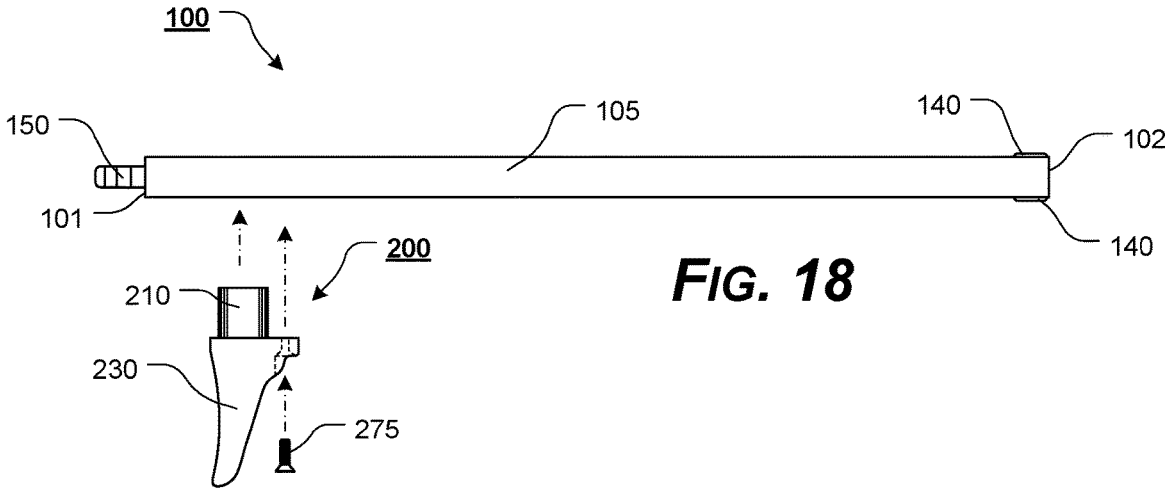
FIG. 18 illustrates a top view showing various components of an exemplary embodiment of a charging assembly, wherein an exemplary handle element is being aligned with an exemplary charging bar, according to an exemplary embodiment of the present disclosure.
Figure 19:
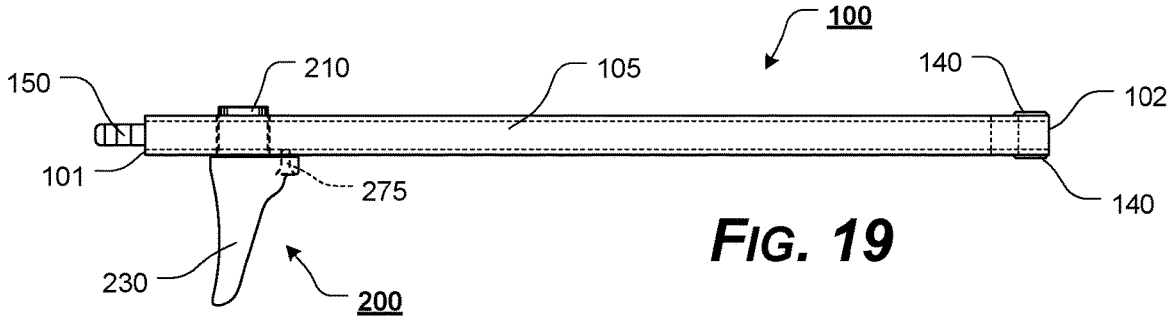
FIG. 19 illustrates a top view showing various components of an exemplary embodiment of a charging assembly, wherein an exemplary handle element is attached or coupled to the charging bar, according to an exemplary embodiment of the present disclosure.
Figure 20:
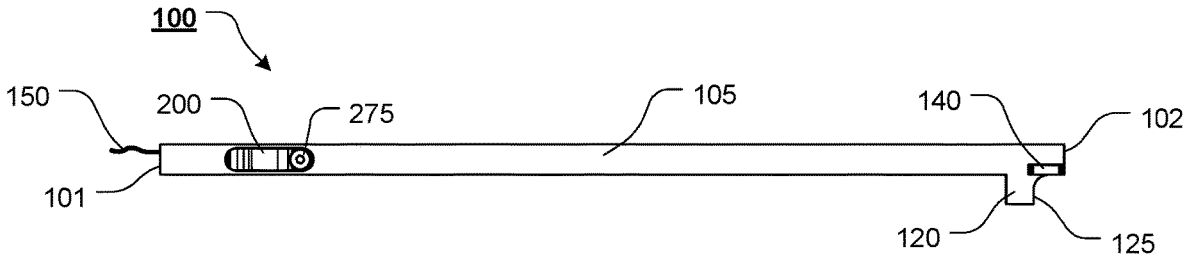
FIG. 20 illustrates a left side view showing various components of an exemplary embodiment of a charging assembly, wherein the handle element attached or coupled to the charging bar, according to an exemplary embodiment of the present disclosure.
Figure 21:
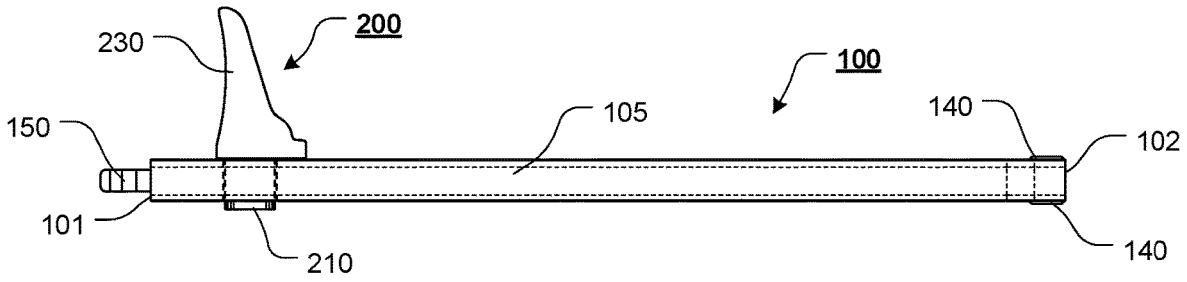
FIG. 21 illustrates a top view showing various components of an exemplary embodiment of a charging assembly, wherein an exemplary handle element is attached or coupled to the charging bar, according to an exemplary embodiment of the present disclosure.
Figure 22:
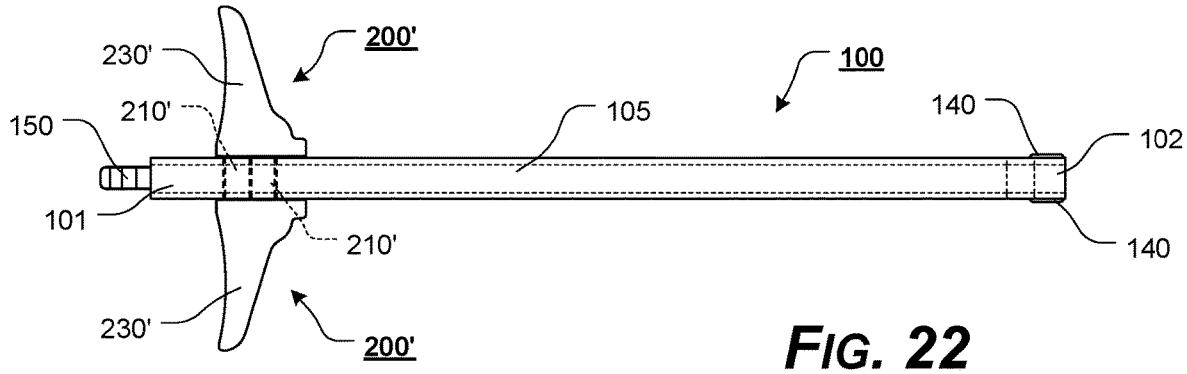
FIG. 22 illustrates a top view showing various components of an exemplary embodiment of a charging assembly, wherein an exemplary handle element is attached or coupled to the charging bar, according to an exemplary embodiment of the present disclosure.

As illustrated, for example, in FIGS. 20-21, it should be appreciated that the handle element 200 may optionally be attached to the charging bar 100 to extend from the left side of the charging bar 100 or the right side of the charging bar 100, respectively. As further illustrated in FIG. 22, a handle element 200' may optionally a handle element base portion 220, a handle element extension portion 230', and a handle element projection 210'. The handle element projection 210' is formed so that opposing handle element projections 210' may interact with one another, allowing two handle elements 200' to be removably attached or coupled to the charging bar 100, each extending from an opposite side wall of the charging bar 100, thereby providing simultaneous, ambidextrous handle elements 200'.

Figure 23:
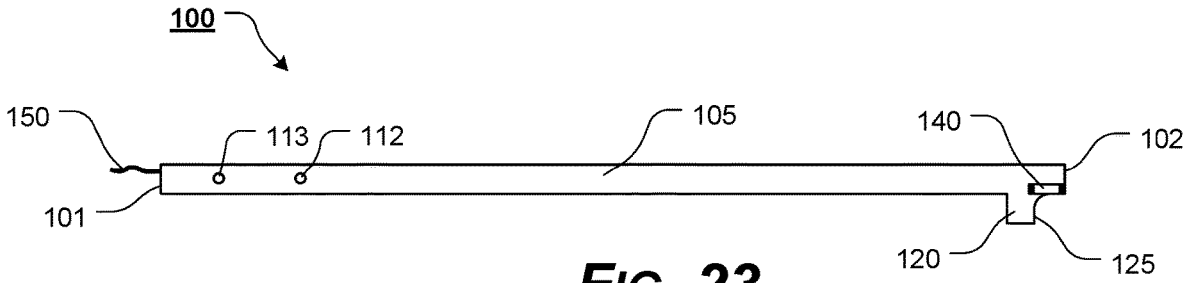
FIG. 23 illustrates a left side view of an exemplary embodiment of a charging bar, according to an exemplary embodiment of the present disclosure.
Figure 24:
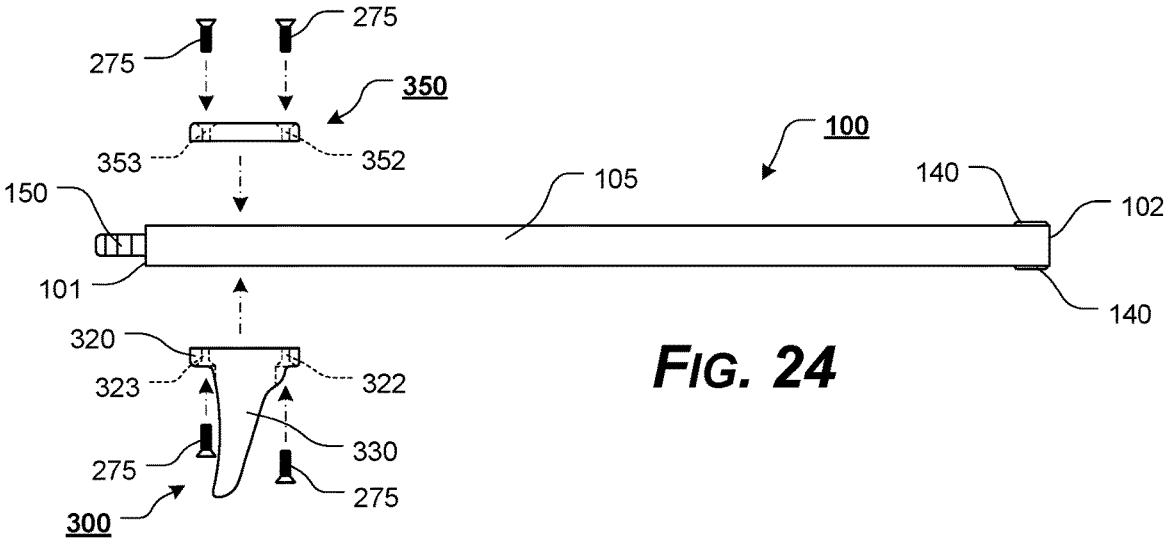
FIG. 24 illustrates a top view showing various components of an exemplary embodiment of a charging assembly, wherein an exemplary handle element is being aligned with an exemplary charging bar, according to an exemplary embodiment of the present disclosure.
Figure 25:
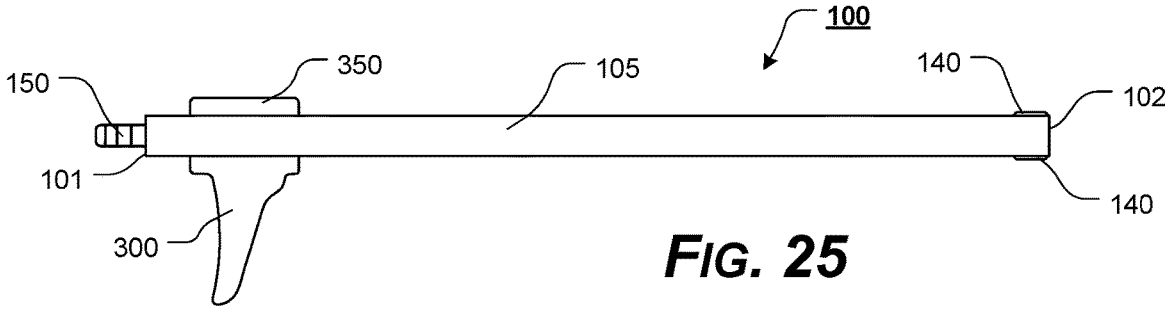
FIG. 25 illustrates a top view showing various components of an exemplary embodiment of a charging assembly, wherein an exemplary handle element is attached or coupled to the charging bar, according to an exemplary embodiment of the present disclosure.
Figure 26:
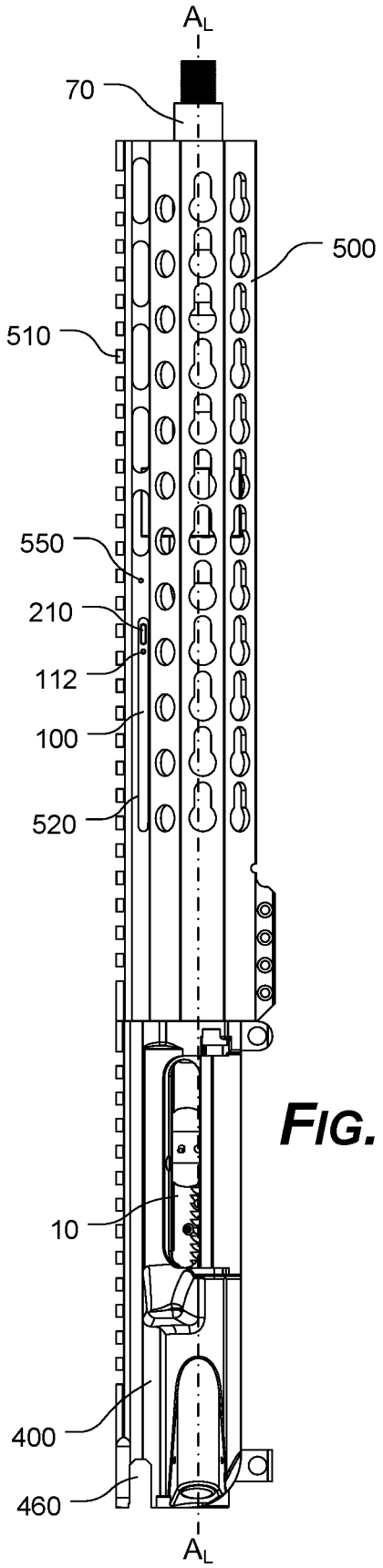
FIG. 26 illustrates a right side view of an exemplary embodiment of a complete firearm upper receiver incorporating an exemplary embodiment of a charging assembly, according to an exemplary embodiment of the present disclosure.
Figure 27:
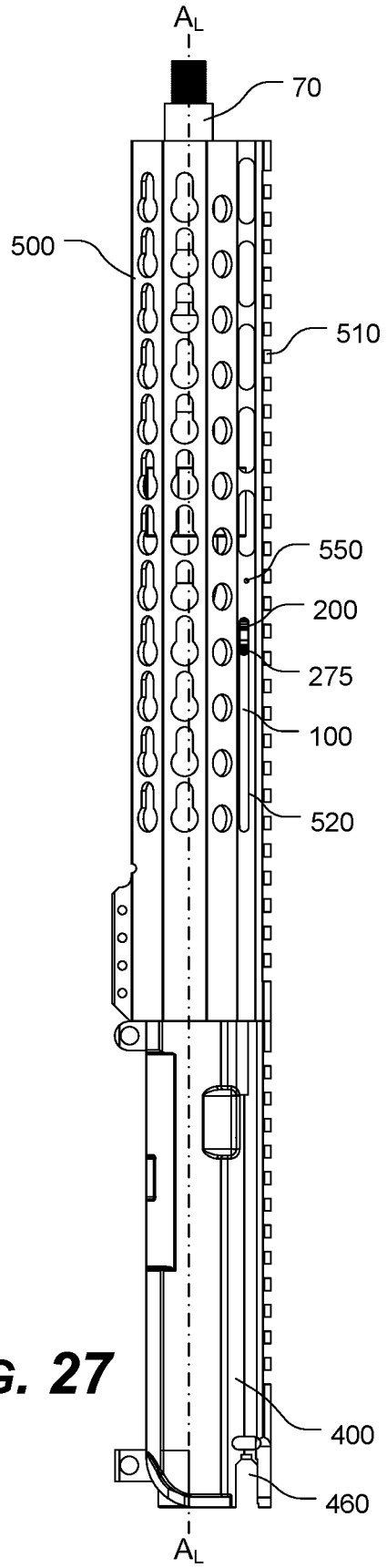
FIG. 27 illustrates a left side view of an exemplary embodiment of a complete firearm upper receiver incorporating an exemplary embodiment of a charging assembly, according to an exemplary embodiment of the present disclosure.
Figure 28:
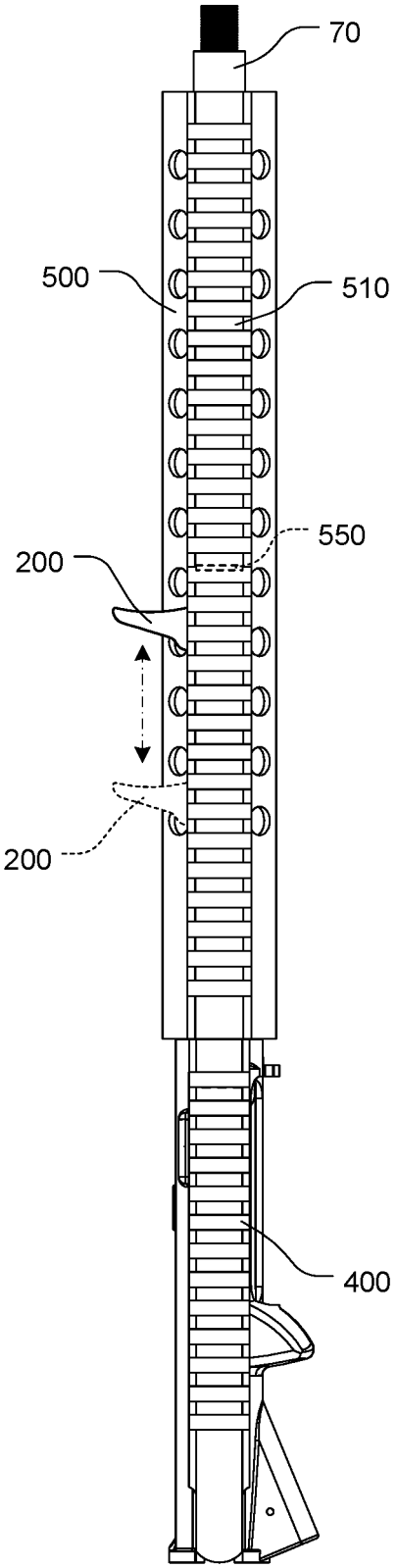
FIG. 28 illustrates a top view of an exemplary embodiment of a complete firearm upper receiver incorporating an exemplary embodiment of a charging assembly, according to an exemplary embodiment of the present disclosure.
Figure 29:
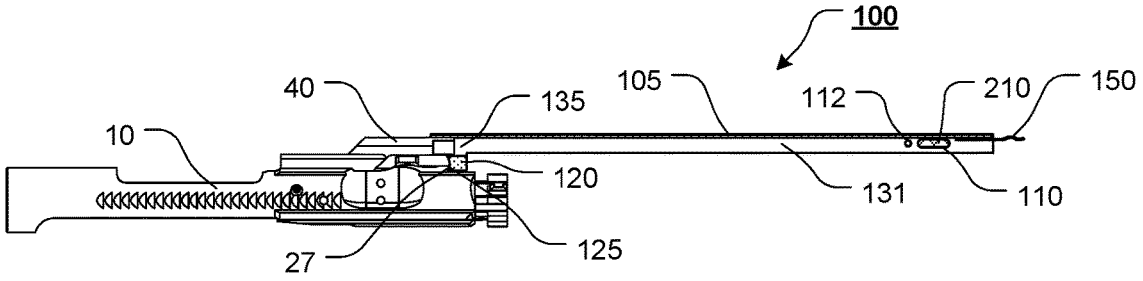
FIG. 29 illustrates a right side view of an exemplary embodiment of a bolt carrier group aligned with an exemplary embodiment of a charging assembly, according to an exemplary embodiment of the present disclosure.

In still other exemplary embodiments, as illustrated in FIGS. 23-25, a handle element 300 may be provided. The handle element 300 includes at least some of a handle element base portion 320 and a handle element extension portion 330. It should be appreciated that these elements correspond to and operates similarly to the handle element base portion 220 and the handle element extension portion 230 of the handle element 220. However, the handle element 300 does not include an equivalent to the handle element projection 210 and includes a first handle element fastener aperture 322 and a second handle element fastener aperture 323.

During use of the handle element 300, the first handle element fastener aperture 322 and the second handle element fastener aperture 333 are aligned with corresponding charging bar fastener apertures 112 and 113 formed through at least one of the side walls 108 and/or 109 of the charging bar 100. Once appropriately aligned, fastener elements 275 are positioned through the first handle element fastener aperture 322 and the second handle element fastener aperture 333 are into the corresponding charging bar fastener apertures 112 and 113.

In certain exemplary embodiments, an alignment element 350, including a first alignment element fastener aperture 352 and a second alignment element fastener aperture 353, may optionally be attached or coupled to the side opposite the side to which the handle element 300 is attached or coupled, to provide alignment of the charging bar 100, relative to the handguard 500 by allowing the handle element 300 to be positioned through the elongate handguard element aperture 520 formed through each side of the handguard 500, proximate an upper portion 510 of the handguard 500.

The handguard 500 may optionally comprise any free float or other handguard that extends from the upper receiver 400 to cover at least a portion of the gas tube 90, gas block 80, and barrel 70. The handguard 500 may optionally include any desired section portion of picatinny rail, apertures, slots, or the like for attaching or coupling of accessories to the handguard 500.

Typically, the handguard 500 includes an interior portion having a circular or keyhole shape. An elongate handguard element aperture 520 is formed along the one or both sides of the handguard 500. In various exemplary embodiments, each elongate handguard element aperture 520 is formed proximate an upper portion 510 of the handguard 500. It should be appreciated that this is merely exemplary and the one or more elongate handguard element apertures 520 may be formed at any position relative to the handguard 500.

Each elongate handguard element aperture 520 is sized so as to allow at least the handguard element projection 210 (if included) and at least a portion of the handguard element base portion 220 (or 320) to be slidably positioned therethrough. The length of each elongate handguard element aperture 520 is a design choice, but should at least allow sufficient travel of the handle element 200 (or 300) along the elongate handguard element aperture 520 to allow the handle element 200 to move the charging bar 100 between the locked or disengaged position, as illustrated, for example, in solid lines in FIG. 28, and the unlocked or engaged position, as illustrated, for example, in broken lines in FIG. 28.

In certain exemplary embodiments, the upper receiver 400 does not include charging handle notches 460 extending from the rear of the upper receiver. In these exemplary embodiments, the charging handle notches 460 are removed and the interior profile of the upper receiver is maintained such that the bolt carrier group 10 and the charging bar 100 can be slidably removed from the rear of the upper receiver 400.

In certain alternative embodiments, as illustrated in FIGS. 36-40, a cover element 600 may optionally be utilized to allow the charging assembly of the present disclosure to be utilized in conjunction with a more standard upper receiver 400 including charging handle notches 460. If utilized, the cover element 600 includes a cover element body 605 with two wing portions 610 extending from the cover element body 605. The wing portions 610 extend to form an open end portion that extends to a rear wall 618. A central portion 615 is formed between the wings 610.

The central portion 615 is sized and shaped so as to be positionable within at least a portion of the charging handle notches 460 of the upper receiver 400 and the wings 610 extend to cover at least a portion of the exterior of the upper receiver, proximate the charging handle notches 460.

A securing tab 625 extends downward from the cover element body. When the cover element 600 is aligned with the rear of the upper receiver 400, the central portion 510 is positioned within at least a portion of the charging handle notches 460 and urged forward such that the rear wall 618 conforms to the upper, rear portion of the lower receiver 400. The securing tab 625 extends downward so as to be engaged by a portion of the lower receiver, when the lower receiver is attached or coupled to the upper receiver 400. In this manner, the cover element 600 is maintained in a desired position relative to the upper receiver 400 and the lower receiver.

When appropriately positioned, the cover element 600 acts to keep propellant gases and other debris from exiting the rear of the upper receiver 400, toward the face of the user.

In certain exemplary embodiments, as illustrated in FIGS. 36-40, the cover element 600 may be formed as an integral unit. Alternatively, the cover element 600 may be formed of at least two portions of material, wherein the cover element body 605 and the securing tab 625 are separate elements, and wherein the securing tab 625 is attached or coupled to the cover element body 605. Suitable materials can be used and sections or elements made independently and attached or coupled together, such as by adhesives, welding, screws, rivets, pins, or other fasteners, to form the various elements of the cover element body 605 and the securing tab 625.

In various exemplary embodiments, various components of the cover element 600 are substantially rigid and are formed of aluminum. Alternate materials of construction of the various components of the cover element 600 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the cover element 600 is a design choice based on the desired appearance and functionality of the cover element 600.

It should also be understood that the overall size and shape of the cover element 600 and the various portions thereof is a design choice based upon the desired functionality and/or appearance of the cover element 600.

During assembly and use, the firearm may initially be presented without the bolt carrier group 10 or the charging bar 100 installed. Initially, the charging bar 100 is slidably positioned so that the first end 100 one of the charging bar 100 is slidably urged through the interior of the upper receiver 400 (from the rear of the upper receiver 400) and the charging bar 100 is aligned within the charging bar receiving aperture 440. The charging bar alignment projections 140 are aligned with the raceways 420 and the charging bar 100 is urged forward, such that the first end 101 is positioned within the handguard 500 and the second end 202 remains positioned within the upper receiver, and the locked position, with the engagement finger 150 engaging the engagement element 550 of the handguard 500 and the bar protrusion 120 adjacent a front wall of the interior of the upper receiver 400.

The handle element 200 is then attached or coupled to the charging bar 100, through the elongate handguard element aperture 520. It should be appreciated that the elongate handguard element aperture 520 may be formed on the right side, the left side, or both sides of the handguard 500 and the handle element 200 may be positioned to extend from the right side or the left side of the handguard 500. If the handguard element projection 210 is positioned within the at least one handle element aperture 110, the distal are furthest and of the handguard element projection 210 optionally extends through the at least one handle element aperture 110 opposite the handguard element extension portion 230 and into the opposing elongate handguard element aperture 520. In this manner, the charging bar 100 and the handguard element 200 are further stabilized relative to the handguard 500 by having portions captured within opposing elongate handguard element apertures 520.

When the handle element 200 is appropriately attached or coupled to the charging bar 100, the bolt carrier group 10 can be inserted within the cavity of the upper receiver 400, in a traditional manner. When fully inserted, the gas key 40 is aligned with the end of the gas tube 90 and extends at least partially into the second charging bar channel 132 and the gas tube aperture 135.

The firearm can then be fully assembled, potentially utilizing the cover element 600, depending upon the configuration of the upper receiver 400.

Once fully assembled, when a sufficient rearward force is applied to the handguard element extension portion 230, the engagement between the engagement finger 150 and the engagement element 550 is overcome and the charging bar 100 is urged from the locked position to the unlocked position. As the charging bar 100 is urged from the locked position to the unlocked position, engagement between the bolt carrier engagement shoulder 125 and the shoulder 27 urges the bolt carrier group 10 rearward, through a normal charging cycle.

If the bolt carrier group 10 is locked rearward, utilizing, for example, a standard bolt catch, the charging bar 100 can be manually moved from the unlocked position forward, to the locked position, via manipulation of the handle element 200. Once in the locked position, the charging bar 100 acts as a non-reciprocating charging bar.

Removal of the charging bar assembly requires initial removal of the handle element 200 from the charging bar 100. Once the handle element 200 has been removed from the charging bar 100 and the bolt carrier group 10 is removed from the upper receiver 400, charging bar 100 can be slidably removed from the upper receiver 400.

It should also be appreciated that a more detailed explanation of the instructions regarding how to install and use the charging assembly for a firearm are not provided herein because it is believed that the level of description provided herein will provide sufficient information to enable one of ordinary skill in the art to understand and practice the disclosure, as described.

While the charging assembly for a firearm of the present disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A charging assembly for a firearm, comprising:

a charging bar extending from a first end to a second end, wherein a charging bar protrusion extends from said charging bar, proximate said second end, wherein a bolt carrier engaging shoulder is formed by said charging bar protrusion, wherein a gas tube aperture is formed through said charging bar protrusion, along a longitudinal axis of said charging bar, wherein a first charging bar channel is formed in said charging bar from said first end to said charging bar protrusion and wherein a second charging bar channel is formed in said charging bar from said charging bar protrusion to said second end, and wherein said gas tube aperture is formed so as to provide an aperture through said charging bar protrusion, between said first charging bar channel and said second charging bar channel, and wherein an engagement finger extends from said first end of said charging bar, wherein at least one handle element aperture is formed through at least one of two side walls of said charging bar, and wherein at least one charging bar fastener aperture is formed through at least one of said side walls of said charging bar;

a handle element, wherein said handle element comprises a handle base portion, a handle element extension portion extending from said handle base portion, and a handle projection extending from said handle base portion, opposite said handle element extension portion; wherein said handle projection is formed so as to be removably positioned within at least a portion of said at least one handle element aperture of said charging bar, and wherein said handle element is removably attached or coupled to said charging bar proximate said first end of said charging bar;

wherein at least a portion of said charging bar is positionable so as to be slidably received within at least a portion of an upper receiver of said firearm and extend into at least a portion of a handguard and wherein at least a portion of said first charging bar channel and said second charging bar channel are formed so as to receive at least a portion of a firearm gas tube therein, through said gas tube aperture, such that said charging bar is positionable between said handguard and at least a portion of said firearm gas tube of said firearm, and such that said bolt carrier engagement shoulder of said charging bar is positioned within said upper receiver of said firearm so as to engage a shoulder of a bolt carrier of said firearm; and wherein said handle element extends from said charging bar, through an elongate handguard element aperture formed through at least a portion of said handguard.

2. The charging assembly for a firearm of claim 1, wherein said first charging bar channel and said second charging bar channel are formed so as to receive at least a portion of a firearm gas tube therein and wherein said gas tube aperture formed in said charging bar protrusion is formed so as to allow at least a portion of said firearm gas tube to be repeatably slidable therethrough.

3. The charging assembly for a firearm of claim 1, wherein said gas tube aperture formed in said charging bar protrusion is formed so as to repeatably, slidably receive at least a portion of a bolt carrier key of said bolt carrier at least partially therein.

4. The charging assembly for a firearm of claim 1, wherein said first charging bar channel is a substantially "U" shaped channel and wherein said second charging bar channel is a substantially "U" shaped channel.

5. The charging assembly for a firearm of claim 1, wherein said first charging bar channel and said second charging bar channel are defined between a top wall and said side walls of said charging bar.

6. The charging assembly for a firearm of claim 1, wherein alignment projections extend from said side walls of said charging bar, proximate said second end, wherein said alignment projections extend from said side walls so as to interact with raceways formed in said upper receiver of said firearm.

7. The charging assembly for a firearm of claim 1, wherein at least one charging element aperture is formed through each of said side walls of said charging bar.

8. The charging assembly for a firearm of claim 1, wherein at least one charging bar fastener aperture is formed through each of said side walls of said charging bar.

9. The charging assembly for a firearm of claim 1, wherein said engagement finger is a spring biased engagement finger formed to releasably engage an engagement element of said handguard.

10. The charging assembly for a firearm of claim 1, wherein said handle base portion comprises a handle element fastener aperture formed through at least a portion of said handle base portion, wherein when said handle projection is removably positioned within at least a portion of said at least one handle element aperture, said handle element fastener aperture is aligned with said charging bar fastener aperture of said charging bar, so as to allow a fastener to pass at least partially through said handle element fastener aperture and into said charging bar fastener aperture.

11. The charging assembly for a firearm of claim 1, wherein said handguard further comprises an engagement element positioned within said handguard so as to interact with said engagement finger, when said charging bar is in a locked or disengaged position to releasably maintain said charging bar in said locked or disengaged position.

12. A charging assembly for a firearm, comprising:

a charging bar, wherein a charging bar protrusion extends from said charging bar, proximate a second end of said charging bar, wherein a bolt carrier engaging shoulder is formed by said charging bar protrusion, wherein a gas tube aperture is formed through said charging bar protrusion, along a longitudinal axis of said charging bar, wherein a first charging bar channel is formed in said charging bar from a first end of said charging bar to said charging bar protrusion and wherein a second charging bar channel is formed in said charging bar from said charging bar protrusion to said second end, and wherein said gas tube aperture is formed so as to provide an aperture through said charging bar protrusion, between said first charging bar channel and said second charging bar channel, and wherein an engagement finger extends from said first end of said charging bar, and wherein at least one charging bar fastener aperture is formed through at least one of said side walls of said charging bar;

a handle element, wherein said handle element comprises a handle base portion and a handle element extension portion extending from said handle base portion; wherein said handle element is removably attached or coupled to said charging bar proximate said first end of said charging bar;

wherein at least a portion of said charging bar is positionable so as to be slidably received within at least a portion of an upper receiver of said firearm and extend into at least a portion of a handguard and wherein at least a portion of said first charging bar channel and said second charging bar channel are formed so as to receive at least a portion of a firearm gas tube therein, through said gas tube aperture, such that said charging bar is positionable between said handguard and at least a portion of said firearm gas tube of said firearm, and such that said bolt carrier engagement shoulder of said charging bar is positioned within said upper receiver of said firearm so as to engage a shoulder of a bolt carrier of said firearm; and wherein said handle element extends from said charging bar, through an elongate handguard element aperture formed through at least a portion of said handguard.

13. The charging assembly for a firearm of claim 12, wherein said first charging bar channel and said second charging bar channel are formed so as to receive at least a portion of a firearm gas tube therein and wherein said gas tube aperture formed in said charging bar protrusion is formed so as to allow at least a portion of said firearm gas tube to be repeatably slidable therethrough.

14. The charging assembly for a firearm of claim 12, wherein said gas tube aperture formed in said charging bar protrusion is formed so as to repeatably, slidably receive at least a portion of a bolt carrier key of said bolt carrier at least partially therein.

15. The charging assembly for a firearm of claim 12, wherein said first charging bar channel is a substantially "U" shaped channel and wherein said second charging bar channel is a substantially "U" shaped channel.

16. The charging assembly for a firearm of claim 12, wherein said first charging bar channel and said second charging bar channel are defined between a top wall and said side walls of said charging bar.

17. The charging assembly for a firearm of claim 12, wherein said engagement finger is a spring biased engagement finger formed to releasably engage an engagement element of said handguard.

18. The charging assembly for a firearm of claim 12, wherein said handguard further comprises an engagement element positioned within said handguard so as to interact with said engagement finger, when said charging bar is in a locked or disengaged position to releasably maintain said charging bar in said locked or disengaged position.

19. A charging assembly for a firearm, comprising:

a charging bar with a charging bar protrusion extending from said charging bar, a bolt carrier engaging shoulder is formed by said charging bar protrusion, a gas tube aperture is formed through said charging bar protrusion, along a longitudinal axis of said charging bar, a first charging bar channel is formed in said charging bar from a first end to said charging bar protrusion and a second charging bar channel is formed in said charging bar from said charging bar protrusion to said second end, and wherein said gas tube aperture is formed so as to provide an aperture through said charging bar protrusion, between said first charging bar channel and said second charging bar channel;

a handle element is removably attached or coupled to said charging bar;

wherein at least a portion of said charging bar is positionable so as to be slidably received within at least a portion of an upper receiver of said firearm and extend into at least a portion of a handguard and wherein at least a portion of said first charging bar channel and said second charging bar channel are formed so as to receive at least a portion of a firearm gas tube therein, through said gas tube aperture, such that said charging bar is positionable between said handguard and at least a portion of said firearm gas tube of said firearm, and such that said bolt carrier engagement shoulder of said charging bar is positioned within said upper receiver of said firearm so as to engage a shoulder of a bolt carrier of said firearm; and wherein said handle element extends from said charging bar, through an elongate handguard element aperture formed through at least a portion of said handguard.

20. The charging assembly for a firearm of claim 19, wherein an engagement finger extends from said first end of said charging bar and wherein said handguard further comprises an engagement element positioned within said handguard so as to interact with said engagement finger, when said charging bar is in a locked or disengaged position to releasably maintain said charging bar in said locked or disengaged position.

* * * * *